US012588699B2

(12) United States Patent
Ajithkumar et al.

(10) Patent No.: US 12,588,699 B2
(45) Date of Patent: Mar. 31, 2026

(54) AEROSOL-GENERATING SUBSTRATE

(71) Applicant: Philip Morris Products S.A., Neuchatel (CH)

(72) Inventors: Anu Ajithkumar, Neuchatel (CH); Daniel Arndt, Neuchatel (CH); Prisca Campanoni, Neuchatel (CH); Damien De Palo, Neuchatel (CH); Corinne Deforel, Neuchatel (CH); Gerhard Lang, Neuchatel (CH); Delphine Langlet, Neuchatel (CH); Jean-Pierre Schaller, Neuchatel (CH); Zoe Odot, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 642 days.

(21) Appl. No.: 17/904,665

(22) PCT Filed: Feb. 24, 2021

(86) PCT No.: PCT/EP2021/054587
§ 371 (c)(1),
(2) Date: Aug. 19, 2022

(87) PCT Pub. No.: WO2021/170670
PCT Pub. Date: Sep. 2, 2021

(65) Prior Publication Data

US 2023/0346001 A1 Nov. 2, 2023

(30) Foreign Application Priority Data

Feb. 28, 2020 (EP) ..... 20160192

(51) Int. Cl.
*A24B 15/30* (2006.01)
*A24B 15/16* (2020.01)
*A24D 1/20* (2020.01)

(52) U.S. Cl.
CPC ..... *A24B 15/302* (2013.01); *A24B 15/16* (2013.01); *A24D 1/20* (2020.01)

(58) Field of Classification Search
None
See application file for complete search history.

(56) References Cited

U.S. PATENT DOCUMENTS 3,860,012 A 1/1975 Selke
3,894,544 A 7/1975 Egri
(Continued)

FOREIGN PATENT DOCUMENTS

CN 104770859 A 7/2015
CN 106714588 A 5/2017
(Continued)

OTHER PUBLICATIONS

JP2019118317A English Machine Translation (Year: 2019).*
(Continued)

*Primary Examiner* — Michael H. Wilson
*Assistant Examiner* — Daniel Edward Vakili
(74) *Attorney, Agent, or Firm* — Oblon, McClelland, Maier & Neustadt, L.L.P.

(57) ABSTRACT

An aerosol-generating article is provided, including an aerosol-generating substrate, the aerosol-generating substrate formed of a homogenised plant material, including: between 1 percent by weight and 65 percent by weight of non-tobacco plant particles, on a dry weight basis; between 15 percent by weight and 55 percent by weight of aerosol former, on a dry weight basis; between 5 percent by weight and 10 percent by weight of cellulose ether, on a dry weight basis; and between 5 percent by weight and 50 percent by weight of additional cellulose, on a dry weight basis, in which the additional cellulose is in a form of isolated cellulose and is not derived from the non-tobacco plant
(Continued)

particles, and in which a ratio of additional cellulose to cellulose ether in the homogenised plant material is at least 2.

16 Claims, 7 Drawing Sheets

(56) References Cited

U.S. PATENT DOCUMENTS

| | | | | |
|---|---|---|---|---|
| 5,724,998 | A | 3/1998 | Gellatly et al. | |
| 7,005,514 | B2 * | 2/2006 | Nguyen | D21C 9/004 536/124 |
| 2016/0309782 | A1 | 10/2016 | Malgat et al. | |
| 2017/0251715 | A1 | 9/2017 | Moldoveanu et al. | |
| 2018/0310608 | A1 | 11/2018 | Sciboz et al. | |
| 2020/0054064 | A1 | 2/2020 | Ajithkumar et al. | |

FOREIGN PATENT DOCUMENTS

| | | | | | |
|---|---|---|---|---|---|
| CN | 108783572 | A | | 11/2018 | |
| CN | 108968139 | A | | 12/2018 | |
| CN | 109393543 | A | | 3/2019 | |
| CN | 109662341 | A | | 4/2019 | |
| CN | 109662343 | A | | 4/2019 | |
| CN | 110771945 | A | * | 2/2020 | A24B 15/16 |
| GB | 983928 | A | | 2/1965 | |
| JP | 2016-538850 | A | | 12/2016 | |
| JP | 2019118317 | A | * | 7/2019 | |
| RU | 2 675 474 | C1 | | 12/2018 | |
| RU | 2 687 632 | C1 | | 5/2019 | |
| WO | WO 95/27411 | A1 | | 10/1995 | |
| WO | WO 96/32854 | A2 | | 10/1996 | |
| WO | WO 2007/010407 | A2 | | 1/2007 | |
| WO | WO 2009/022232 | A2 | | 2/2009 | |
| WO | WO 2011/060961 | A1 | | 5/2011 | |
| WO | WO 2013/034488 | A2 | | 3/2013 | |
| WO | WO 2013/068100 | A1 | | 5/2013 | |
| WO | WO 2013/068304 | A1 | | 5/2013 | |
| WO | WO 2014/154887 | A1 | | 10/2014 | |
| WO | WO 2015/082651 | A1 | | 6/2015 | |
| WO | WO 2015/082652 | A1 | | 6/2015 | |
| WO | WO 2015/177255 | A1 | | 11/2015 | |
| WO | WO 2017/155739 | A1 | | 9/2017 | |
| WO | WO 2018/215481 | A1 | | 11/2018 | |
| WO | WO 2018/230002 | A1 | | 12/2018 | |
| WO | WO-2018229087 | A1 | * | 12/2018 | A24B 3/14 |
| WO | WO 2020/074494 | A1 | | 4/2020 | |
| WO | WO 2020/074535 | A1 | | 4/2020 | |
| WO | WO-2020089093 | A1 | * | 5/2020 | A24C 5/01 |
| WO | WO-2020235112 | A1 | * | 11/2020 | A24B 15/14 |
| WO | WO 2020/239597 | A1 | | 12/2020 | |
| WO | WO 2021/078683 | A1 | | 4/2021 | |
| WO | WO 2021/078691 | A1 | | 4/2021 | |
| WO | WO 2021/122583 | A1 | | 6/2021 | |

OTHER PUBLICATIONS

Watanabe CN110771945A English Machine Translation (Year: 2020).*

International Search Report and Written Opinion issued Jun. 9, 2021, in PCT/EP2021/054587 filed Feb. 24, 2021, 11 pages.

"Natural Reinforcing Materials—BioPowder", Retrieved from the Internet: URL:https://www.bio-powder.com/en/natural-reinforcing-materials; retrieved on May 31, 2021, XP055809111, 4 pages.

Bu-Chin et al.: "Structure and biological activities of new carnosic acid—(CA) and carnosol (CS)-related compounds generated by heat treatment of rosemary". Apr. 2019, Phytochemistry Letter 30: 43-48.

Arndt, D. et al, "In depth characterization of chemical differences between heat-not-burn tobacco products and cigarettes using LC-HRAM-MS-based non-targeted differential screening", Jun. 2018, (DOI: 10.13140/RG.2.2.11752.16643).

Wachsmuth, C. et al, "Comprehensive chemical characterization of complex matrices through integration of multiple analytical modes and databases for LC-HRAM-MS-based non-targeted screening", Jun. 2018, (DOI: 10.13140/RG.2.2.12701.61927).

Buchholz, C. et al, "Increasing confidence for compound identification by fragmentation database and in silico fragmentation comparison with LC-HRAM-MS-based non-targeted screening of complex matrices", Jun. 2018, (DOI: 10.13140/RG.2.2.17944.49927).

Arndt, D. et al, "A complex matrix characterization approach, applied to cigarette smoke, that integrates multiple analytical methods and compound identification strategies for non-targeted liquid chromatography with high-resolution mass spectrometry" (DOI: 10.1002/rcm.8571).ar.

Almstetter et al, "Non-targeted screening using GC×GC-TOFMS for in-depth chemical characterization of aerosol from a heat-not-burn tobacco product", Jun. 2018, (DOI: 10.13140/RG.2.2.36010.31688/1).

Almstetter et al, "Non-targeted differential screening of complex matrices using GC×GC-TOFMS for comprehensive characterization of the chemical composition and determination of significant differences", Jun. 2016, (DOI: 10.13140/RG.2.2.32692.55680).

Extended European Search Report issued Sep. 23, 2020, in corresponding European Patent Application No. 20160192.9, 7 pages.

Russian Office Action and Search Report mailed May 31, 2024 in corresponding Russian Patent Application No. 2022124969 (with English translation), 10 pages.

Combined Chinese Office Action and Search Report issued May 14, 2025 in Chinese Patent Application No. 202180015623.4 (submitting English Translation only), 11 pages.

Japanese Notice of Allowance issued Jul. 10, 2025 in Japanese Patent Application No. 2022-551661, 1 pages.

Office Action mailed on Jan. 19, 2026, in corresponding Korean Patent Application No. 2022-7033001 (with English translation), citing document 1 therein.

* cited by examiner

AEROSOL-GENERATING SUBSTRATE

The present invention relates to aerosol-generating substrates comprising homogenised plant material formed from non-tobacco plant particles and to aerosol-generating articles incorporating such an aerosol-generating substrate.

Aerosol-generating articles in which an aerosol-generating substrate, such as a tobacco-containing substrate, is heated rather than combusted, are known in the art. Typically in such articles, an aerosol is generated by the transfer of heat from a heat source to a physically separate aerosol-generating substrate or material, which may be located in contact with, within, around, or downstream of the heat source. During use of the aerosol-generating article, volatile compounds are released from the substrate by heat transfer from the heat source and are entrained in air drawn through the article. As the released compounds cool, they condense to form an aerosol.

Some aerosol-generating articles comprise a flavourant that is delivered to the consumer during use of the article to provide a different sensory experience to the consumer, for example to enhance the flavour of aerosol. A flavourant can be used to deliver a gustatory sensation (taste), an olfactory sensation (smell), or both a gustatory and an olfactory sensation to the user inhaling the aerosol. It is known to provide heated aerosol-generating articles that include flavourants.

It is also known to provide flavourants in conventional combustible cigarettes, which are smoked by lighting the end of the cigarette opposite the mouthpiece so that the tobacco rod combusts, generating inhalable smoke. One or more flavourants are typically mixed with the tobacco in the tobacco rod in order to provide additional flavour to the mainstream smoke as the tobacco is combusted. Such flavourants can be provided, for example, as essential oil.

Aerosol from a conventional cigarette, which contains a multitude of components interacting with receptors located in the mouth provides a sensation of "mouthfullness," that is to say, a relatively high mouthfeel. "Mouthfeel," as used herein refers to the physical sensations in the mouth caused by food, drink, or aerosol, and is distinct from taste. It is a fundamental sensory attribute which, along with taste and smell, determines the overall flavour of a food item or aerosol. However, aerosol from a conventional cigarette may also provide an undesirable sensation of irritation, bitterness or astringency.

There are difficulties involved in replicating the consumer experience provided by conventional combustible cigarettes with aerosol-generating articles in which the aerosol-generating substrate is heated rather than combusted. This is partially due to the lower temperatures reached during the heating of such aerosol-generating articles, leading to a different profile of volatile compounds being released.

It would be desirable to provide a novel aerosol-generating substrate for a heated aerosol-generating article providing an aerosol with improved flavour and mouthfullness. It would be particularly desirable if such an aerosol-generating substrate could provide an aerosol with a sensorial experience that is comparable to that provided by a conventional combustible cigarette. It would be particularly desirable if such an aerosol-generating substrate could provide an aerosol having a reduced sensation of irritation, bitterness and astringency compared to that provided by a conventional combustible cigarette.

It would further be desirable to provide such an aerosol-generating substrate that can be readily incorporated into an aerosol-generating article and which can be manufactured using existing high-speed methods and apparatus.

The present disclosure relates to an aerosol-generating article comprising an aerosol-generating substrate, the aerosol-generating substrate formed of a homogenised plant material. The homogenised plant material may comprise between 1 percent by weight and 65 percent by weight of non-tobacco plant particles or between 1 percent by weight and 65 percent by weight of tobacco particles, on a dry weight basis. The homogenised plant material may comprise between 15 percent by weight and 55 percent by weight of aerosol former, on a dry weight basis. The homogenised plant material may comprise between 2 percent by weight and 10 percent by weight of cellulose ether, on a dry weight basis. The homogenised plant material may comprise between 5 percent by weight and 50 percent by weight of additional cellulose, on a dry weight basis. The additional cellulose may not be derived from the non-tobacco plant particles. The ratio of additional cellulose to cellulose ether may be at least 2.

According to the invention there is provided an aerosol-generating article comprising an aerosol-generating substrate, the aerosol-generating substrate formed of a homogenised plant material comprising: between 1 percent by weight and 65 percent by weight of non-tobacco plant particles, on a dry weight basis; between 15 percent by weight and 55 percent by weight of aerosol former, on a dry weight basis; between 2 percent by weight and 10 percent by weight of cellulose ether, on a dry weight basis; and between 5 percent by weight and 50 percent by weight of additional cellulose, on a dry weight basis. According to the present invention, the additional cellulose is not derived from the non-tobacco plant particles and the ratio of additional cellulose to cellulose ether in the homogenised plant material is at least 2.

According to the invention there is further provided an aerosol-generating article comprising an aerosol-generating substrate, the aerosol-generating substrate formed of a homogenised plant material comprising: between 1 percent by weight and 65 percent by weight of tobacco particles, on a dry weight basis; between 15 percent by weight and 55 percent by weight of aerosol former, on a dry weight basis; between 2 percent by weight and 10 percent by weight of cellulose ether, on a dry weight basis; and between 5 percent by weight and 50 percent by weight of additional cellulose, on a dry weight basis. According to the present invention, the additional cellulose is not derived from the tobacco particles and the ratio of additional cellulose to cellulose ether in the homogenised plant material is at least 2.

As used herein, the term "aerosol-generating article" refers to an article for producing an aerosol, wherein the article comprises an aerosol-generating substrate that is suitable and intended to be heated or combusted in order to release volatile compounds that can form an aerosol. A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in "heated aerosol-generating articles", an aerosol is generated by heating an aerosol-generating substrate and not by combusting the aerosol-generating substrate. Known heated aerosol-generating articles include, for example, electrically heated aerosol-generating articles and aerosol-generating articles in which an aerosol is generated by the transfer of heat from a combustible fuel element or heat source to a physically separate aerosol-generating substrate.

Also known are aerosol-generating articles that are adapted to be used in an aerosol-generating system that supplies the aerosol former to the aerosol-generating articles. In such a system, the aerosol-generating substrate in the aerosol-generating articles contain substantially less aerosol former relative to those aerosol-generating substrate which carries and provides substantially all the aerosol former used in forming the aerosol during operation.

As used herein, the term "aerosol-generating substrate" refers to a substrate capable of producing upon heating volatile compounds, which can form an aerosol. The aerosol generated from aerosol-generating substrates may be visible to the human eye or invisible and may include vapours (for example, fine particles of substances, which are in a gaseous state, that are ordinarily liquid or solid at room temperature) as well as gases and liquid droplets of condensed vapours.

As used herein, the term "homogenised plant material" encompasses any plant material formed by the agglomeration of particles of plant. For example, sheets or webs of homogenised plant material for the aerosol-generating substrates of the present invention may be formed by agglomerating particles of plant material obtained by pulverising, grinding or comminuting non-tobacco plant material and optionally one or more of tobacco leaf lamina and tobacco leaf stems. The homogenised plant material may be produced by casting, extrusion, paper making processes or other any other suitable processes known in the art.

As used herein, the term "plant particles" encompasses particles derived from any suitable plant material and which are capable of generating one or more volatile flavour compounds upon heating. This term should be considered to exclude particles of inert plant material such as cellulose, that do not contribute to the sensory output of the aerosol-generating substrate. Depending upon the plant from which the plant particles are derived, the plant particles may be produced from ground or powdered leaf lamina, fruits, stalks, stems, roots, seeds, buds or bark or any other suitable portion of the plant.

According to one aspect of the invention, the plant particles comprise non-tobacco plant particles. The non-tobacco plant particles may be used in combination with tobacco particles, or the homogenised plant material may be substantially free from tobacco. According to another aspect of the invention, the plant particles are tobacco particles. As used herein, the term "plant particles" refers to the non-tobacco plant particles, the tobacco particles, or the combination thereof as provided in the homogenised plant material.

As used herein, the term "additional cellulose" encompasses any cellulose material incorporated into the homogenised plant material which does not derive from the non-tobacco plant particles or tobacco particles provided in the homogenised plant material. The additional cellulose is incorporated in the homogenised plant material in addition to the non-tobacco plant material or tobacco material, as a separate and distinct source of cellulose to any cellulose intrinsically provided within any plant particles that are present. In particular, the additional cellulose is in the form of isolated cellulose. This means that the cellulose derives from plant material but has been extracted and separated from other components of the plant material, such as lignin and hemicellulose. The additional cellulose is therefore provided extrinsically from any plant material that is present and has been at least partially purified.

Preferably, the additional cellulose is in the form of an inert cellulosic material, which is sensorially neutral. The additional cellulose therefore does not substantially impact the organoleptic characteristics of the aerosol generated from the aerosol-generating substrate. For example, the additional cellulose is preferably a substantially tasteless and odorless material.

Preferably, less than about 2 percent by weight of each of the characteristic compounds present in the homogenised plant material, as defined below, originates from the additional cellulose, more preferably less than about 1 percent by weight and most preferably about 0 percent by weight, on a dry weight basis.

Preferably, less than about 2 percent by weight of any nicotine present in the homogenised plant material originates from the additional cellulose, more preferably less than about 1 percent by weight and most preferably about 0 percent by weight, on a dry weight basis.

The additional cellulose therefore preferably provides negligible amounts and preferably a substantially zero amount of any of the characteristic compounds from the non-tobacco material or tobacco material.

The additional cellulose may consist of one type of cellulose material, or may be a combination of different types of cellulose material which provide different properties, as described in more detail below.

The present invention provides an aerosol-generating article including a novel aerosol-generating substrate formed of a homogenised plant material formed with at least one of non-tobacco plant particles and tobacco particles in combination with cellulose ether and additional cellulose material. The combination of cellulose ether and additional cellulose material, at the defined level and with the defined ratio, has been advantageously found to provide a homogenised plant material having an improved tensile strength and homogeneity.

For certain non-tobacco plants, it has previously been found to be technically difficult to produce a homogenised plant material having an acceptable tensile strength when the proportion of non-tobacco plant particles is above a certain level. With such plants, it is therefore difficult to provide a useable homogenised plant material having a sufficiently high level of the non-tobacco plant particles to achieve the desired level of flavour within the generated aerosol. Typically, above a threshold level of the non-tobacco plant particles, the homogenised plant material has been found to have a low tensile strength and to have an inhomogeneous texture. If the tensile strength of the homogenised plant material is too low, it is fragile and cannot be processed effectively to form an aerosol-generating substrate, in particular on an industrial scale.

The inventors of the present application have discovered that by using the specific combination of cellulose ether and additional cellulose in the homogenised plant material, as defined above, a more effective binding effect of the non-tobacco plant particles can be achieved and the resulting homogenised plant material has a significantly higher tensile strength. The resultant homogenised plant material can therefore be readily processed to form an aerosol-generating substrate, using existing high speed apparatus and techniques. For certain non-tobacco plant materials, it is therefore possible to produce acceptable homogenised plant materials having a higher level of the non-tobacco plant particles than has been previously possible.

In addition, the use of this combination of cellulose ether and additional cellulose in the aerosol-generating substrate of aerosol-generating articles according to the invention has been found to provide an improved delivery of aerosol from the aerosol-generating substrate. In particular, a significant improvement can be achieved in the delivery of aerosol from aerosol-generating substrates which are heated to a relatively low temperature during use in order to generate an aerosol. For example, as described in more detail below, the present invention has been found to be particularly effective for aerosol-generating substrates which are adapted for to be heated to a temperature of less than 275 degrees Celsius during use.

As defined above, the homogenised plant material forming the aerosol-generating substrate of aerosol-generating articles according to the present invention comprises between about 2 percent by weight and about 10 percent by weight of cellulose ether, on a dry weight basis. The cellulose ether has been found to provide highly effective binding properties when used together with the plant particles in the homogenised plant material.

The homogenised plant material comprises at least about 2 percent by weight of cellulose ether, preferably at least about 3 percent by weight of cellulose ether, more preferably at least about 4 percent by weight of cellulose ether and more preferably about 5 percent by weight of cellulose ether, on a dry weight basis.

The homogenised plant material comprises no more than about 10 percent by weight of cellulose ether, preferably no more than about 9 percent by weight of cellulose ether, more preferably no more than about 8 percent by weight of cellulose ether, more preferably no more than about 7 percent by weight of cellulose ether, on a dry weight basis.

For example, the homogenised plant material may comprise between about 3 percent by weight and about 9 percent by weight of cellulose ether, or between about 4 percent by weight and about 8 percent by weight of cellulose ether, or between about 4 percent by weight and about 7 percent by weight of cellulose ether, or about 5 percent by weight of cellulose ether, on a dry weight basis.

Suitable cellulose ethers for use in the present invention include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). In particularly preferred embodiments, the cellulose ether is carboxymethyl cellulose.

The additional cellulose incorporated in the homogenised plant material forming the aerosol-generating substrate of aerosol-generating articles according to the present invention is thought to provide additional structure and reinforcement to bind and support the plant particles and aerosol former within the homogenised material.

The additional cellulose may comprise cellulose powder.

The term "cellulose powder" is used herein to refer to a refined cellulose material in powder form that has been derived from the processing and purification of cellulose-containing plant fibers. The cellulose powder is therefore a cellulose material that has been at least partially purified.

Preferably, the cellulose powder has at least about 90 percent purity, more preferably at least about 95 percent purity, more preferably at least about 97 percent purity and more preferably at least about 99 percent purity.

Preferably, the cellulose powder comprises at least about 90 percent by weight of cellulose, more preferably at least about 95 percent by weight of cellulose and most preferably at least about 97 percent by weight of cellulose, more preferably at least about 99 percent by weight of cellulose, based on dry weight. The amount of cellulose can be determined using techniques known in the art.

Preferably, the cellulose powder is formed of particles with an average particle size of less than about 250 microns, more preferably less than about 100 microns.

The cellulose powder may be in the form of a powdered cellulose product that has been formed by the mechanical disintegration and purification of cellulose fibres, without chemical modification. Cellulose powder is classified as food additive E460(ii), according to the Regulation (EC) No. 1333/2008.

Alternatively, the cellulose powder may be in the form of a chemically modified cellulose, such as microcrystalline cellulose, which is classified as food additive number E460 (i) according to the Regulation (EC) 1333/2008. Microcrystalline cellulose is a pure, partially depolymerised cellulose in crystalline form, which is synthesized by treating alpha-cellulose with mineral acids.

A suitable cellulose powder for use in the present invention is available as Microcrystalline Cellulose Type SK-105 or SK-101, or Cellulose Powder Type M-60 from Gumix International, Inc. of New Jersey.

Preferably, the amount of cellulose powder corresponds to at least about 5 percent by weight of the homogenised plant material, based on dry weight, more preferably at least about 6 percent by weight of the homogenised plant material, more preferably at least about 7 percent by weight homogenised plant material and more preferably at least about 8 percent by weight homogenised plant material, on a dry weight basis.

The amount of cellulose powder may be adapted above this minimum level depending upon the weight amount of the other components within the homogenised plant material and in particular, depending upon the weight amount of the plant particles. In certain embodiments, the cellulose powder may replace a proportion of the plant particles within the homogenised plant material, without a significant impact on the characteristics of the aerosol generated.

Preferably, the amount of cellulose powder corresponds to no more than about 45 percent by weight of the homogenised plant material, more preferably no more than about 40 percent by weight of the homogenised plant material, on a dry weight basis.

In certain embodiments, for example, embodiments having a relatively high level of plant particles in the homogenised plant material, the amount of cellulose powder may be relatively low. In such embodiments, the amount of cellulose powder may be between about 5 percent by weight and about 15 percent by weight of the homogenised plant material, or between about 6 percent by weight and about 12 percent by weight of the homogenised plant material, or between about 7 percent by weight and about 11 percent by weight of the homogenised plant material, or between about 8 percent by weight and about 10 percent by weight of the homogenised plant material, on a dry weight basis.

In other embodiments, for example, embodiments having a relatively low level of plant particles in the homogenised plant material, the amount of cellulose powder may be relatively high. In such embodiments, the amount of cellulose powder may be between about 15 percent by weight and about 45 percent by weight of the homogenised plant material, or between about 20 percent by weight and about 40 percent by weight of the homogenised plant material, or between about 25 percent by weight and about 35 percent by weight of the homogenised plant material, on a dry weight basis.

Preferably, the ratio by weight of cellulose powder to cellulose ether in the homogenised plant material is at least about 1.5, i.e. the amount of cellulose powder is at least 1.5 times the amount of cellulose ether. More preferably, the ratio by weight of cellulose powder to cellulose ether in the homogenised plant material is at least about 1.6, more preferably at least about 1.8.

Alternatively or in addition to the cellulose powder, the additional cellulose may comprise cellulose reinforcement fibers. The term "cellulose reinforcement fibers" is used herein to refer to fibers obtained directly from plant-based materials, wherein each fiber has a length that is significantly greater than its width. The cellulose reinforcement fibers preferably have a fiber length of at least 400 microns. Suitable cellulose reinforcement fibers for use in the present invention include, for example, wood pulp fibers. A suitable source of cellulose reinforcement fibers for use in the present invention is available as ECF Bleached Hardwood Kraft Pulp from Storaenso, Sweden.

The cellulose reinforcement fibers may advantageously act as mechanical reinforcement in the homogenised plant material forming the aerosol-generating substrate of aerosol-generating articles according to the invention. The cellulose reinforcement fibers may improve the binding of the plant particles in the homogenised plant material and provide an improvement in tensile strength, in combination with the cellulose ether.

Preferably, the amount of cellulose reinforcement fibers corresponds to at least about 3 percent by weight of the homogenised plant material, based on dry weight, more preferably at least about 4 percent by weight of the homogenised plant material, more preferably at least about 5 percent by weight homogenised plant material and more preferably at least about 6 percent by weight homogenised plant material, on a dry weight basis.

Preferably, the amount of cellulose reinforcement fibers corresponds to no more than about 12 percent by weight of the homogenised plant material, more preferably at least about 11 percent by weight of the homogenised plant material, more preferably at least about 10 percent by weight of the homogenised plant material, more preferably at least about 8 percent by weight of the homogenised plant material, on a dry weight basis.

For example, the homogenised plant material may comprise between about 3 percent by weight and about 12 percent by weight of cellulose reinforcement fibers, or between about 4 percent by weight and about 11 percent by weight of cellulose reinforcement fibers, or between about 5 percent by weight and about 10 percent by weight of cellulose reinforcement fibers, or between about 6 percent by weight and about 8 percent by weight of cellulose reinforcement fibers, on a dry weight basis.

Preferably, the ratio by weight of cellulose reinforcement fibers to cellulose ether in the homogenised plant material is at least about 0.5, i.e. the amount of cellulose reinforcement fibers is at least half the amount of cellulose ether. More preferably, the ratio by weight of cellulose reinforcement fibers to cellulose ether in the homogenised plant material is at least about 0.75, more preferably at least about 1.

In preferred embodiments, the additional cellulose comprises cellulose powder and cellulose reinforcement fibers. In such embodiments, the ratio by weight of cellulose powder to cellulose reinforcement fibers is preferably at least about 1.5, more preferably at least about 1.75, more preferably at least about 2.

Preferably, the amount of additional cellulose provided in the homogenised plant material is adapted such that the total amount of additional cellulose and plant particles corresponds to no more than 75 percent by weight of the homogenised plant material. Preferably, at least about 25 percent by weight of the homogenised plant material is therefore provided by other components, including the cellulose ether and aerosol former.

The homogenised plant material forming the aerosol-generating substrate of aerosol-generating articles according to the present invention further comprises between about 5 percent by weight and about 55 percent by weight of aerosol former. Upon volatilisation, an aerosol former can convey other vaporised compounds released from the aerosol-generating substrate upon heating, such as nicotine and flavourants, in an aerosol. Suitable aerosol formers for inclusion in the homogenised plant material are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate. The homogenised plant material may comprise a single aerosol former, or a combination of two or more aerosol formers.

In preferred embodiments of the invention, the aerosol former is glycerol.

Preferably, the homogenised plant material comprises at least about 10 percent by weight of aerosol former, more preferably at least about 15 percent by weight of aerosol former, on a dry weight basis.

Preferably, the homogenised plant material comprises no more than about 50 percent by weight of aerosol former, more preferably no more than about 45 percent by weight of aerosol former, on a dry weight basis.

The amount of aerosol former may be adapted depending on the composition of the homogenised plant material, such as the type or amount of the plant particles, in order to achieve an aerosol having the desired levels of flavour compounds from the plant particles. The amount of aerosol former may also be adapted depending on the way in which it is intended to heat the aerosol-generating substrate during use and in particular, the temperature to which the aerosol-generating substrate will be heated during heating of the aerosol-generating article in an associated aerosol-generating device.

In certain embodiments of the invention, the aerosol-generating substrate is adapted to be heated to a temperature of greater than 300 degrees Celsius, for example, around 350 degrees Celsius. This temperature range is typically provided when the aerosol-generating substrate is heated by an internal heater element, for example, in the commercially available IQOS device (Philip Morris Products SA, Switzerland). In such embodiments, the homogenised plant material preferably comprises between about 5 percent by weight and about 40 percent by weight of aerosol former, more preferably between about 10 percent by weight and about 35 percent by weight of aerosol former, more preferably between about 15 percent by weight and about 30 percent by weight of aerosol former, more preferably between about 15 percent by weight and about 30 percent by weight of aerosol former, on a dry weight basis.

In a preferred embodiment of the invention, the homogenised plant material comprises between 50 percent by weight and 65 percent by weight of non-tobacco particles on a dry weight basis; and between 15 percent by weight and 25 percent by weight of aerosol former on a dry weight basis.

In another preferred embodiment of the invention, the homogenised plant material comprises between 50 percent by weight and 65 percent by weight of tobacco particles on a dry weight basis; and between 15 percent by weight and 25 percent by weight of aerosol former on a dry weight basis.

In other embodiments of the invention, the aerosol-generating substrate is adapted to be heated to a temperature of less than 300 degrees Celsius, or less than 275 degrees Celsius. In such embodiments, it is generally found to be advantageous to provide a relatively high level of aerosol former in order to provide the desired levels of flavour compounds from the plant particles in the aerosol generated upon heating. In such embodiments, the homogenised plant material preferably comprises between about 30 percent by weight and about 55 percent by weight of aerosol former, more preferably between about 30 percent by weight and about 50 percent by weight of aerosol former, more preferably between about 30 percent by weight and about 45 percent by weight of aerosol former, on a dry weight basis.

In a preferred embodiment of the invention, the homogenised plant material comprises between 10 percent by weight and 55 percent by weight of non-tobacco particles on a dry weight basis; and between 30 percent by weight and 45 percent by weight of aerosol former on a dry weight basis.

In another preferred embodiment of the invention, the homogenised plant material comprises between 10 percent by weight and 55 percent by weight of tobacco particles on a dry weight basis; and between 30 percent by weight and 45 percent by weight of aerosol former on a dry weight basis.

In such embodiments where the aerosol-generating substrate is intended to be heated at a relatively low temperature, the inclusion of the cellulose ether in the homogenised plant material is advantageously found to improve the formation of the aerosol and in particular, the delivery of the aerosol former compared to other binder materials.

As defined above, the homogenised plant material comprises between about 1 percent by weight and about 65 percent by weight of plant particles, wherein the plant particles provide the flavour compounds to the aerosol generated from the aerosol-generating substrate. The plant particles may be non-tobacco plant particles, tobacco particles, or a combination of non-tobacco plant particles and tobacco particles. The amount of plant particles provided in the homogenised plant material may be adapted depending upon the level of the flavour compounds desired in the resultant aerosol. This may depend to a certain extent on the selection of the plant from which the plant particles are derived or the level of any other flavour providing components of the homogenised plant material.

Preferably, the homogenised plant material comprises at least about 5 percent by weight of plant particles, more preferably at least about 10 percent by weight of plant particles, more preferably at least about 15 percent by weight of plant particles and more preferably at least about 20 percent by weight of plant particles.

Preferably, the homogenised plant material comprises no more than about 60 percent by weight of plant particles, more preferably no more than about 55 percent by weight of plant particles, more preferably no more than about 50 percent by weight of plant particles, more preferably no more than about 45 percent by weight of plant particles.

As defined above, according to a first aspect of the invention, the homogenised plant material comprises non-tobacco plant particles. The non-tobacco plant particles may derive from one or more non-tobacco plants, depending upon the desired flavour of the resultant aerosol.

Preferably, the non-tobacco plant particles comprise rosemary particles, ginger particles, star anise particles, clove particles, *eucalyptus* particles or combinations thereof.

In certain embodiments, substantially all of the plant particles forming the homogenised plant material are the non-tobacco plant particles. In alternative embodiments, the homogenised plant material comprises the non-tobacco plant particles in combination with at least one of tobacco particles or *cannabis* particles, as described below. Preferably, the total weight amount of non-tobacco particles, tobacco particles and *cannabis* particles is no greater than 65 percent by weight on a dry weight basis.

In the following description of the invention, the term "particulate plant material" is used to refer collectively to the particles of plant material that are used to form the homogenised plant material.

Where the homogenised plant material comprises a combination of non-tobacco plant particles and tobacco particles, the homogenised plant material preferably comprises at least about 1 percent by weight of tobacco particles, more preferably at least about 5 percent by weight of tobacco particles, more preferably at least about 10 percent by weight of tobacco particles, more preferably at least about 20 percent by weight of tobacco particles, more preferably at least about 30 percent by weight of tobacco particles, more preferably at least about 40 percent by weight of tobacco particles, on a dry weight basis. Preferably, the homogenised plant material comprises up to about 64 percent by weight of tobacco particles, more preferably up to about 60 percent by weight of tobacco particles, more preferably up to about 55 percent by weight of tobacco particles, more preferably up to about 50 percent by weight of tobacco particles, on a dry weight basis.

The weight ratio of the non-tobacco plant particles to the tobacco particles in the particulate plant material forming the homogenised plant material may vary depending on the desired flavour characteristics and composition of the aerosol. For example, the weight ratio of non-tobacco plant particles to tobacco particles may be between about 1:60 and 60:1, or between about 1:10 and about 10:1, or between about 1:5 and 5:1.

According to a second aspect of the invention, the homogenised plant material comprises tobacco particles. In certain embodiments, substantially all of the plant particles forming the homogenised plant material are tobacco particles. Alternatively, the tobacco particles may be combined with one or more other types of plant particle, as described above.

With reference to all embodiments of the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. In a preferred embodiment, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, and other specialty tobaccos.

Flue-curing is a method of curing tobacco, which is particularly used with Virginia tobaccos. During the flue-curing process, heated air is circulated through densely packed tobacco. During a first stage, the tobacco leaves turn yellow and wilt. During a second stage, the laminae of the leaves are completely dried. During a third stage, the leaf stems are completely dried.

Burley tobacco plays a significant role in many tobacco blends. Burley tobacco has a distinctive flavour and aroma and also has an ability to absorb large amounts of casing.

Oriental is a type of tobacco which has small leaves, and high aromatic qualities. However, Oriental tobacco has a milder flavour than, for example, Burley. Generally, therefore, Oriental tobacco is used in relatively small proportions in tobacco blends.

Kasturi, Madura and Jatim are subtypes of sun-cured tobacco that can be used. Preferably, Kasturi tobacco and flue-cured tobacco may be used in a blend to produce the tobacco particles. Accordingly, the tobacco particles in the particulate plant material may comprise a blend of Kasturi tobacco and flue-cured tobacco.

The tobacco particles may have a nicotine content of at least about 2.5 percent by weight, based on dry weight. More preferably, the tobacco particles may have a nicotine content of at least about 3 percent, even more preferably at least about 3.2 percent, even more preferably at least about 3.5 percent, most preferably at least about 4 percent by weight, based on dry weight. When the aerosol-generating substrate contains tobacco particles in combination with non-tobacco particles, tobaccos having a higher nicotine content are preferred to maintain similar levels of nicotine relative to typical aerosol-generating substrates without non-tobacco particles, since the total amount of nicotine would otherwise be reduced due to substitution of tobacco particles with non-tobacco particles.

Nicotine may optionally be incorporated into the aerosol-generating substrate although this would be considered as a non-tobacco material for the purposes of the invention. The nicotine may comprise one or more nicotine salts selected from the list consisting of nicotine lactate, nicotine citrate, nicotine pyruvate, nicotine bitartrate, nicotine benzoate, nicotine pectate, nicotine alginate, and nicotine salicylate. Nicotine may be incorporated in addition to a tobacco with low nicotine content, or nicotine may be incorporated into an aerosol-generating substrate that has a reduced or zero tobacco content.

Preferably, the homogenised plant material comprises one or more organic acids to bind nicotine in the homogenised plant material through the formation of one or more nicotine salts. The one or more organic acids are preferably one or more carboxylic acids. The carboxylic acid may include a ketone group. Preferably the carboxylic acid may include a ketone group having less than about 10 carbon atoms, or less. Preferred carboxylic acids for use in the present invention include but are not limited to lactic acid and levulinic acid. Preferably, the homogenised plant material comprises between about 0.5 percent by weight and about 2 percent by weight of an acid, most preferably lactic acid.

Preferably, the aerosol-generating substrate comprises at least 0.1 milligrams of nicotine per gram of the substrate, on a dry weight basis. More preferably, the aerosol-generating substrate comprises at least about 0.5 mg of nicotine per gram of the substrate, more preferably at least about 1 mg of nicotine per gram of the substrate, more preferably at least about 1.5 mg of nicotine per gram of the substrate, more preferably at least about 2 mg of nicotine per gram of the substrate, more preferably at least about 3 mg of nicotine per gram of the substrate, more preferably at least about 4 mg of nicotine per gram of the substrate, more preferably at least about 5 mg of nicotine per gram of the substrate, on a dry weight basis.

Preferably, the aerosol-generating substrate comprises up to about 50 mg of nicotine per gram of the substrate, on a dry weight basis. More preferably, the aerosol-generating substrate comprises up to about 45 mg of nicotine per gram of the substrate, more preferably up to about 40 mg of nicotine per gram of the substrate, more preferably up to about 35 mg of nicotine per gram of the substrate, more preferably up to about 30 mg of nicotine per gram of the substrate, more preferably up to about 25 mg of nicotine per gram of the substrate, more preferably up to about 20 mg of nicotine per gram of the substrate, on a dry weight basis.

For example, the aerosol-generating substrate may comprise between about 0.1 mg and about 50 mg of nicotine per gram of the substrate, or between about 0.5 mg and about 45 mg of nicotine per gram of the substrate, or between about 1 mg and about 40 mg of nicotine per gram of the substrate, or between about 2 mg and about 35 mg of nicotine per gram of the substrate, or between about 5 mg and about 30 mg of nicotine per gram of the substrate, or between about 10 mg and about 25 mg of nicotine per gram of the substrate, or between about 15 mg and about 20 mg of nicotine per gram of the substrate, on a dry weight basis. In certain preferred embodiments of the invention, the aerosol-generating substrate comprises between about 1 mg and about 20 mg of nicotine per gram of the substrate, on a dry weight basis.

The defined ranges of nicotine content for the aerosol-generating substrate include all forms of nicotine which may be present in the aerosol-generating substrate, including nicotine intrinsically present in tobacco material as well as nicotine that has been optionally added separately to the aerosol-generating substrate, for example, in the form of a nicotine salt.

Alternatively or in addition to the inclusion of tobacco particles into the homogenised plant material of the aerosol-generating substrate according to the invention, the homogenised plant material may comprise at least about 1 percent by weight of *cannabis* particles, on a dry weight basis. The term "*cannabis* particles" refers to particles of a *cannabis* plant, such as the species *Cannabis sativa, Cannabis indica*, and *Cannabis ruderalis.*

Preferably, the homogenised plant material comprises at least about 1 percent by weight of *cannabis* particles, more preferably at least about 5 percent by weight of *cannabis* particles, more preferably at least about 10 percent by weight of *cannabis* particles, more preferably at least about 20 percent by weight of *cannabis* particles, more preferably at least about 30 percent by weight of *cannabis* particles, more preferably at least about 40 percent by weight of *cannabis* particles, on a dry weight basis.

Preferably, the homogenised plant material comprises up to about 64 percent by weight of *cannabis* particles, more preferably up to about 60 percent by weight of *cannabis* particles, more preferably up to about 55 percent by weight of *cannabis* particles, more preferably up to about 50 percent by weight of *cannabis* particles, on a dry weight basis.

One or more cannabinoid compounds may optionally be incorporated into the aerosol-generating substrate although this would be considered as a non-*cannabis* material for the purposes of the invention. As used herein with reference to the invention, the term "cannabinoid compound" describes any one of a class of naturally occurring compounds that are found in parts of the *cannabis* plant—namely the species *Cannabis sativa, Cannabis indica*, and *Cannabis ruderalis*. Cannabinoid compounds are especially concentrated in the female flower heads and commonly sold as *cannabis* oil. Cannabinoid compounds naturally occurring the in *cannabis* plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

For example, the aerosol-generating substrate may comprise a cannabinoid compound selected from the group consisting of: tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT) and combinations thereof.

In particularly preferred embodiments of the invention, the homogenised plant material comprises rosemary particles. The inventors of the present invention have found that through the incorporation of rosemary particles into the aerosol-generating substrate, it is advantageously possible to produce an aerosol which provides a novel sensory experience. Such an aerosol provides unique flavours and may provide an increased level of mouthfullness.

In addition, the inventors have found that it is advantageously possible to produce an aerosol with an improved rosemary aroma and flavour compared to the aerosol produced through the addition of rosemary additives such as rosemary oil. Rosemary oil is distilled from the leaves, of the rosemary plant and has a composition of flavourants that are different from rosemary particles, presumably due to the distillation process which may selectively remove or retain certain flavourants. Moreover, in certain aerosol-generating substrates provided herein, rosemary particles may be incorporated at a sufficient level to provide the desired rosemary flavour whilst maintaining sufficient tobacco material to provide the desired level of nicotine to the consumer.

Furthermore, it has been surprisingly found that the inclusion of rosemary particles in an aerosol-generating substrate provides a significant reduction in certain undesirable aerosol compounds compared to an aerosol produced from an aerosol-generating substrate comprising 100 percent tobacco particles without rosemary particles.

In such embodiments, the homogenised plant material may comprise between about 10 percent by weight and about 65 percent by weight of rosemary particles. The homogenised plant material may optionally comprise a combination of rosemary particles and tobacco particles.

For example, in one preferred embodiment, the homogenised plant material comprises between about 50 percent by weight and about 65 percent by weight of rosemary particles on a dry weight basis. In such embodiments, the homogenised plant material preferably comprises between about 15 percent by weight and about 25 percent by weight of aerosol former on a dry weight basis.

For homogenised plant materials in which the plant particles comprise rosemary particles, it has previously been found difficult to form a sheet of the homogenised plant material having a content of plant particles that is higher than about 30 percent by weight, using known cast leaf processes. With this relatively high level of rosemary particles, the resultant homogenised plant material has been found to be particularly fragile and porous, with a low tensile strength, so that the homogenised plant material is not suitable for use in the formation of an aerosol-generating substrate. The inventors of the present application surprisingly found that by incorporating the combination of cellulose ether and additional cellulose, as defined above, into the homogenised plant material, it became possible to produce a significantly improved homogenised plant material incorporating up to 65 percent by weight of rosemary particles. In particular, a homogenised plant material comprising between 50 percent by weight and 60 percent by weight of rosemary particles could be produced, which is homogenous in texture and with a significantly improved tensile strength.

In another preferred embodiment, the homogenised plant material comprises between about 10 percent by weight and about 55 percent by weight of rosemary particles on a dry weight basis and between about 35 percent by weight and about 45 percent by weight of aerosol former on a dry weight basis. This embodiment, in which the aerosol former content is relatively high, is particularly suitable for use in a heating device which heats the aerosol-generating substrate to a temperature of less than 275 degrees, as described above. The relatively high aerosol former content provides an optimal delivery of flavour compounds from the rosemary particles into the aerosol generated from the aerosol-generating substrate upon heating.

The presence of rosemary in homogenised plant material (such as cast leaf) can be positively identified by DNA barcoding. Methods for performing DNA barcoding based on the nuclear gene ITS2, the rbcL and matK system as well as the plastid intergenic spacer trnH-psbA, are well known in the art and can be used (Chen S, Yao H, Han J, Liu C, Song J, et al. (2010) Validation of the ITS2 Region as a Novel DNA Barcode for Identifying Medicinal Plant Species. PLoS ONE 5(1): e8613; Hollingsworth P M, Graham S W, Little D P (2011) Choosing and Using a Plant DNA Barcode. PLoS ONE 6(5): e19254).

The inventors have carried out a complex analysis and characterisation of the aerosols generated from aerosol-generating substrates of the present invention incorporating rosemary particles and a mixture of rosemary and tobacco particles, and a comparison of these aerosols with those produced from existing aerosol-generating substrates formed from tobacco material without rosemary particles. Based on this, the inventors have been able to identify a group of "characteristic compounds" that are compounds present in the aerosols and which have derived from the rosemary particles. The detection of these characteristic compounds within an aerosol within a specific range of weight proportion can therefore be used to identify aerosols that have derived from an aerosol-generating substrate including rosemary particles. These characteristic compounds are notably not present in an aerosol generated from tobacco material. Furthermore, the proportion of the characteristic compounds within the aerosol and the ratio of the characteristic compounds to each other are clearly indicative of the use of rosemary plant material and not a rosemary oil. Similarly, the presence of these characteristic compounds in specific proportions within an aerosol-generating substrate is indicative of the inclusion of rosemary particles in the substrate.

In particular, the defined levels of the characteristic compounds within the substrate and the aerosol are specific to the rosemary particles present within the homogenised plant material. The level of each characteristic compound is dependent upon the way in which the rosemary particles are processed during production of the homogenised plant material. The level is also dependent upon the composition of the homogenised plant material and in particular, will be affected by the level of other components within the homogenised plant material. The level of the characteristic compounds within the homogenised plant material will be different to the level of the same compound within the starting rosemary material. It will also be different to the level of the characteristic compounds within materials containing rosemary particles but that are not in accordance with the invention as defined herein.

In a similar way, characteristic compounds can be identified for other plant materials, with the presence of the characteristic compounds at a level within specifically defined ranges being indicative of the inclusion of the plant material in a homogenised plant material.

In order to carry out the characterisation of the aerosols, the inventors have made use of complementary non-targeted differential screening (NTDS) using liquid chromatography coupled to high-resolution accurate-mass mass spectrometry (LC-HRAM-MS) in parallel with two-dimensional gas chromatography coupled to time-of-flight mass spectrometry (GC×GC-TOFMS).

Non-targeted screening (NTS) is a key methodology for characterising the chemical composition of complex matrices by either matching unknown detected compound features against spectral databases (suspect screening analysis [SSA]), or if no pre-knowledge matches, by elucidating the structure of unknowns using e.g. first order fragmentation (MS/MS) derived information matched to in silico predicted fragments from compound databases (non-targeted analysis [NTA]). It enables the simultaneous measurement and capability for semi-quantification of a large number of small molecules from samples using an unbiased approach.

If the focus is on the comparison of two or more aerosol samples, as described above, to evaluate any significant differences in chemical composition between samples in an unsupervised way or if group related pre-knowledge is available between sample groups, non-targeted differential screening (NTDS) may be performed. A complementary differential screening approach using liquid chromatography coupled to high-resolution accurate-mass mass spectrometry (LC-HRAM-MS) in parallel with two-dimensional gas chromatography coupled to time-of-flight mass spectrometry (GC×GC-TOFMS) has been applied in order to ensure comprehensive analytical coverage for identifying the most relevant differences in aerosol composition between aerosols derived from articles comprising 100% by weight rosemary as the particulate plant material and those derived from articles comprising 100% by weight tobacco as the particulate plant material.

The aerosol was generated and collected using the apparatus and methodology set out in detail below.

LC-HRAM-MS analysis was carried out using a Thermo QExactive™ high resolution mass spectrometer in both full scan mode and data dependent mode. In total, three different methods were applied in order to cover a wide range of substances with different ionization properties and compound classes. Samples were analysed using RP chromatography with heated electrospray ionisation (HESI) in both positive and negative modes and with atmospheric pressure chemical ionisation (APCI) in positive mode. The methods are described in: Arndt, D. et al, "In depth characterization of chemical differences between heat-not-burn tobacco products and cigarettes using LC-H RAM-MS-based non-targeted differential screening" (DOI:10.13140/RG.2.2.11752.16643); Wachsmuth, C. et al, "Comprehensive chemical characterisation of complex matrices through integration of multiple analytical modes and databases for LC-H RAM-MS-based non-targeted screening" (DOI: 10.13140/RG.2.2.12701.61927); and "Buchholz, C. et al, "Increasing confidence for compound identification by fragmentation database and in silico fragmentation comparison with LC-HRAM-MS-based non-targeted screening of complex matrices" (DOI: 10.13140/RG.2.2.17944.49927), all from the 66th ASMS Conference on Mass Spectrometry and Allied Topics, San Diego, USA (2018). The methods are further described in: Arndt, D. et al, "A complex matrix characterization approach, applied to cigarette smoke, that integrates multiple analytical methods and compound identification strategies for non-targeted liquid chromatography with high-resolution mass spectrometry" (DOI: 10.1002/rcm.8571).ar GC×GC-TOFMS analysis was carried out using an Agilent GC Model 6890A or 7890A instrument equipped with an Auto Liquid Injector (Model 7683B) and a Thermal Modulator coupled to a LECO Pegasus 4D™ mass spectrometer with three different methods for nonpolar, polar and highly volatile compounds within the aerosol. The methods are described in: Almstetter et al, "Non-targeted screening using GC×GC-TOFMS for in-depth chemical characterization of aerosol from a heat-not-burn tobacco product" (DOI: 10.13140/RG.2.2.36010.31688/1); and Almstetter et al, "Non-targeted differential screening of complex matrices using GC×GC-TOFMS for comprehensive characterization of the chemical composition and determination of significant differences" (DOI: 10.13140/RG.2.2.32692.55680), from the 66th and 64th ASMS Conferences on Mass Spectrometry and Allied Topics, San Diego, USA, respectively.

The results from the analysis methods provided information regarding the major compounds responsible for the differences in the aerosols generated by such articles. The focus of the non-targeted differential screening using both analytical platforms LC-HRAM-MS and GC×GC-TOFMS was on compounds that were present in greater amounts in the aerosols of a sample of an aerosol-generating substrate according to the invention comprising 100 percent rosemary particles relative to a comparative sample of an aerosol-generating substrate comprising 100 percent tobacco particles. The NTDS methodology is described in the papers listed above.

Based on this information, the inventors were able to identify specific compounds within the aerosol that may be considered as "characteristic compounds" deriving from the rosemary particles in the substrate. Characteristic compounds unique to rosemary include but are not limited to: betulinic acid ((3β)-3-Hydroxy-lup-20(29)-en-28-oic acid, chemical formula: $C_{30}H_{48}O_3$, Chemical Abstracts Service Registry Number 472-15-1); rosmaridiphenol (4,5-dihydroxy-12,12-dimethyl-6-(propan-2-yl)tricyclo[9.4.0.0$^{3,8}$]pentadeca-3,5,7-trien-2-one), chemical formula: $C_{20}H_{28}O_3$, Chemical Abstracts Service Registry Number 1729-95-2; and 12-O-methylcarnosol, chemical formula: $C_{21}H_{28}O_4$, Chemical Abstracts Service Registry Number 85514-27-8.

For the purposes of the present invention, a targeted screening can be conducted on a sample of aerosol-generating substrate to identify the presence and amount of each of the characteristic compounds in the substrate. Such a targeted screening method is described below. As described, the characteristic compounds can be detected and measured in both the aerosol-generating substrate and the aerosol derived from the aerosol-generating substrate.

As defined above, certain preferred embodiments of the aerosol-generating article of the invention comprise an aerosol-generating substrate formed of a homogenised plant material comprising rosemary particles. As a result of the inclusion of the rosemary particles, the aerosol-generating substrate comprises certain proportions of the "characteristic compounds" of rosemary, as described above. In particular, the aerosol-generating substrate preferably comprises at least 50 micrograms of betulinic acid per gram of the substrate, at least 20 micrograms of rosmaridiphenol per gram of the substrate, and at least 0.3 micrograms of 12-O-methylcarnosol per gram of the substrate, on a dry weight basis.

By defining an aerosol-generating substrate with respect to the desired levels of the characteristic compounds, it is possible to ensure consistency between products despite potential differences in the levels of the characteristic compounds in the raw materials. This advantageously enables the quality of the product to be controlled more effectively.

Preferably, the aerosol-generating substrate comprises at least about 100 microgram of betulinic acid per gram of the substrate, more preferably at least about 250 micrograms of betulinic acid per gram of the substrate, more preferably at least about 500 micrograms of betulinic acid per gram of substrate, on a dry weight basis. Alternatively or in addition, the aerosol-generating substrate preferably comprises no more than about 4000 micrograms of betulinic acid per gram of the substrate, more preferably no more than about 3500 micrograms of betulinic acid per gram of the substrate, more preferably no more than about 3000 micrograms of betulinic acid per gram of the substrate and more preferably no more than about 2500 micrograms of betulinic acid per gram of the substrate, on a dry weight basis.

For example, the aerosol-generating substrate may comprise between about 50 micrograms and about 4000 micrograms betulinic acid per gram of the substrate, or between about 100 micrograms and about 3500 micrograms betulinic acid per gram of the substrate, or between about 250 micrograms and about 3000 micrograms betulinic acid per gram of the substrate, or between about 500 micrograms and about 2500 micrograms betulinic acid per gram of the substrate, on a dry weight basis.

Preferably, the aerosol-generating substrate comprises at least about 50 micrograms of rosmaridiphenol per gram of the substrate, more preferably at least about 100 micrograms of rosmaridiphenol per gram of the substrate, more preferably at least about 200 micrograms of rosmaridiphenol per gram of the substrate on a dry weight basis. Alternatively or in addition, the aerosol-generating substrate preferably comprises no more than about 2000 micrograms of rosmaridiphenol per gram of the substrate, more preferably no more than about 1750 micrograms of rosmaridiphenol per gram of the substrate, more preferably no more than about 1500 micrograms of rosmaridiphenol per gram of the substrate and more preferably no more than about 1000 micrograms of rosmaridiphenol per gram of the substrate, on a dry weight basis.

For example, the aerosol-generating substrate may comprise between about 20 micrograms and about 2000 micrograms rosmaridiphenol per gram of the substrate, or between about 50 micrograms and about 1750 micrograms rosmaridiphenol per gram of the substrate, or between about 100 micrograms and about 1500 micrograms rosmaridiphenol per gram of the substrate, or between about 200 micrograms and about 1000 micrograms rosmaridiphenol per gram of the substrate on a dry weight basis.

Preferably, the aerosol-generating substrate comprises at least about 1 microgram of 12-O-methylcarnosol per gram of the substrate, more preferably at least about 2 micrograms of 12-O-methylcarnosol per gram of the substrate, more preferably at least about 4 micrograms of 12-O-methylcarnosol per gram of the substrate on a dry weight basis. Alternatively or in addition, the aerosol-generating substrate preferably comprises no more than about 40 micrograms of 12-O-methylcarnosol per gram of the substrate, more preferably no more than about 30 micrograms of 12-O-methylcarnosol per gram of the substrate, more preferably no more than about 25 micrograms of 12-O-methylcarnosol per gram of the substrate and more preferably no more than about 20 micrograms of 12-O-methylcarnosol per gram of the substrate, on a dry weight basis.

For example, the aerosol-generating substrate may comprise between about 0.3 micrograms and about 40 micrograms 12-O-methylcarnosol per gram of the substrate, or between about 1 microgram and about 30 micrograms 12-O-methylcarnosol per gram of the substrate, or between about 2 micrograms and about 25 micrograms 12-O-methylcarnosol per gram of the substrate, or between about 4 micrograms and about 20 micrograms of 12-O-methylcarnosol per gram of the substrate on a dry weight basis.

Preferably, the ratio of the characteristic compounds in the aerosol-generating substrate is such that the amount of betulinic acid per gram of the substrate is at least 2 times the amount of rosmaridiphenol per gram of the substrate, more preferably at least 2.5 times the amount of rosmaridiphenol per gram of the substrate, even more preferably at least 3 times the amount of rosmaridiphenol per gram of the substrate.

This ratio of betulinic acid to rosmaridiphenol is characteristic of the inclusion of rosemary particles in the aerosol-generating substrate.

Preferably, the aerosol-generating substrate comprises greater than 0.5 percent by weight of 1,8-cineole, on a dry weight basis. More preferably, the aerosol-generating substrate comprises greater than about 1 percent by weight of 1,8-cineole, on a dry weight basis.

As defined above, the invention also provides an aerosol-generating article that comprises an aerosol-generating substrate formed of a homogenised plant material comprising rosemary particles, wherein upon heating of the aerosol-generating substrate, an aerosol is generated which comprises the "characteristic compounds" of rosemary.

For the purposes of the invention, the aerosol-generating substrate is heated according to "Test Method A". In Test Method A, an aerosol-generating article incorporating the aerosol-generating substrate is heated in a Tobacco Heating System 2.2 holder (THS2.2 holder) under the Health Canada machine-smoking regimen. For the purposes of carrying out Test Method A, the aerosol-generating substrate is provided in an aerosol-generating article that is compatible with the THS2.2 holder.

The Tobacco Heating System 2.2 holder (THS2.2 holder) corresponds to the commercially available IQOS device (Philip Morris Products SA, Switzerland) as described in Smith et al., 2016, Regul. Toxicol. Pharmacol. 81 (S2) S82-S92. Aerosol-generating articles for use in conjunction with the IQOS device are also commercially available.

The Health Canada smoking regimen is a well-defined and accepted smoking protocol as defined in Health Canada 2000—Tobacco Products Information Regulations SOR/2000-273, Schedule 2; published by Ministry of Justice Canada. The test method is described in ISO/TR 19478-1: 2014. In a Health Canada smoking test, an aerosol is collected from the sample aerosol-generating substrate over 12 puffs with a puff volume of 55 millimetres, puff duration of 2 seconds and puff interval of 30 seconds, with all ventilation blocked if ventilation is present.

Thus, in the context of the present invention, the expression "upon heating of the aerosol-generating substrate according to Test Method A" means upon heating of the aerosol-generating substrate in a THS2.2 holder under the Health Canada machine-smoking regimen as defined in Health Canada 2000—Tobacco Products Information Regulations SOR/2000-273, Schedule 2; published by Ministry of Justice Canada, the test method being described in ISO/TR 19478-1:2014.

For the purposes of analysis, the aerosol generated from the heating of the aerosol-generating substrate is trapped using suitable apparatus, depending upon the method of analysis that is to be used. In a suitable method for generating samples for analysis by LC-HRAM-MS, the particulate phase is trapped using a conditioned 44 mm Cambridge glass fiber filter pad (according to ISO 3308) and a filter holder (according to ISO 4387 and ISO 3308). The remaining gas phase is collected downstream from the filter pad using two consecutive micro-impingers (20 mL) containing methanol and internal standard (ISTD) solution (10 mL) each, maintained at −60 degrees Celsius, using a dry ice-isopropanol mixture. The trapped particulate phase and gas phase are then recombined and extracted using the methanol from the micro-impingers, by shaking the sample, vortexing for 5 minutes and centrifuging (4500 g, 5 minutes, 10 degrees Celsius). The resultant extract is diluted with methanol and mixed in an Eppendorf ThermoMixer (5 degrees Celsius, 2000 rpm). Test samples from the extract are analysed by LC-HRAM-MS in combined full scan mode and data dependent fragmentation mode for identification of the characteristic compounds. For the purposes of the invention, LC-HRAM-MS analysis is suitable for the identification and quantification of betulinic acid, rosmaridiphenol and 12-O-methylcarnosol.

Samples for analysis by GC×GC-TOFMS may be generated in a similar way but for GC×GC-TOFMS analysis, different solvents are suitable for extracting and analysing polar compounds, non-polar compounds and volatile compounds separated from whole aerosol.

For non-polar and polar compounds, whole aerosol is collected using a conditioned 44 mm Cambridge glass fiber filter pad (according to ISO 3308) and a filter holder (according to ISO 4387 and ISO 3308), followed by two micro-impingers connected and sealed in series. Each micro-impinger (20 mL) contains 10 mL dichloromethane/methanol (80:20 v/v) containing internal standard (ISTD) and retention index marker (RIM) compounds. The micro-impingers are maintained at −80 degrees Celsius, using a dry ice-isopropanol mixture. For analysis of the non-polar compounds, the particulate phase of the whole aerosol is extracted from the glass fiber filter pad using the contents of the micro-impingers. Water is added to an aliquot (10 mL) of the resulting extract and the sample is shaken and centrifuged as described above. The dichloromethane layer is separated, dried with sodium sulphate and analysed by GC×GC-TOFMS in full scan mode. For analysis of the polar compounds, the remaining water layer from the non-polar sample preparation described above is used. ISTD and RIM compounds are added to the water layer, which is then directly analysed by GC×GC-TOFMS in full scan mode.

For volatile compounds, whole aerosol is collected using two micro-impingers (20 mL) connected and sealed in series, each filled with 10 mL N,N-dimethylformamide (DMF) containing ISTD and RIM compounds. The micro-impingers are maintained at between −50 and −60 degrees Celsius using a dry ice-isopropanol mixture. After collection, the contents of the two micro-impingers are combined and analysed by GC×GC-TOFMS in full scan mode.

For the purposes of the invention, GC×GC-TOFMS analysis is suitable for the identification and quantification of 12-O-methylcarnosol.

The aerosol generated upon heating of the aerosol-generating substrate of the invention according to Test Method A is preferably characterised by the amounts and ratios of the characteristic compounds, betulinic acid, rosmaridiphenol and 12-O-methylcarnosol, as defined above.

Preferably, in an aerosol-generating article comprising an aerosol-generating substrate as described above, upon heating the aerosol-generating substrate according to Test Method A, an aerosol is generated comprising at least 30 micrograms of betulinic acid per gram of the substrate, on a dry weight basis; at least 1 microgram of rosmaridiphenol per gram of the substrate, on a dry weight basis; and at least 1 microgram of 12-O-methylcarnosol per gram of the substrate, on a dry weight basis.

The ranges define the amount of each of the characteristic compounds in the aerosol generated per gram of the aerosol-generating substrate (also referred to herein as the "substrate"). This equates to the total amount of the characteristic compound measured in the aerosol collected during Test Method A, divided by the dry weight of the aerosol-generating substrate prior to heating.

Upon heating of the aerosol-generating substrate according to Test Method A, an aerosol is preferably generated that preferably comprises at least about 30 micrograms of betulinic acid per gram of the substrate, on a dry weight basis.

More preferably, the aerosol generated from an aerosol-generating substrate according to the present invention comprises at least about 100 micrograms of betulinic acid per gram of the substrate, on a dry weight basis. Even more preferably, the aerosol generated from an aerosol-generating substrate according to the present invention comprises at least about 250 micrograms of betulinic acid per gram of the substrate, on a dry weight basis. Alternatively, or in addition, the aerosol generated from the aerosol-generating substrate preferably comprises up to about 3000 micrograms of betulinic acid per gram of the substrate, on a dry weight basis. More preferably, the aerosol generated from the aerosol-generating substrate comprises up to about 2500 micrograms of betulinic acid per gram of the substrate, on a dry weight basis. Even more preferably, the aerosol generated from the aerosol-generating substrate comprises up to about 2000 micrograms of betulinic acid per gram of the substrate, on a dry weight basis.

Upon heating of the aerosol-generating substrate according to Test Method A, an aerosol is generated that preferably comprises at least about 1 microgram of rosmaridiphenol per gram of the substrate, on a dry weight basis.

Preferably, the aerosol generated from an aerosol-generating substrate according to the present invention further comprises at least about 10 micrograms of rosmaridiphenol per gram of the substrate, on a dry weight basis. More preferably, the aerosol generated from an aerosol-generating substrate according to the present invention comprises at least about 25 micrograms of rosmaridiphenol per gram of the substrate, on a dry weight basis. Alternatively, or in addition, the aerosol generated from the aerosol-generating substrate preferably comprises up to about 150 micrograms of rosmaridiphenol per gram of the substrate, on a dry weight basis. More preferably, the aerosol generated from the aerosol-generating substrate comprises up to about 120 micrograms of rosmaridiphenol per gram of the substrate, on a dry weight basis. Even more preferably, the aerosol generated from the aerosol-generating substrate comprises up to about 100 micrograms of rosmaridiphenol per gram of the substrate, on a dry weight basis.

Upon heating of the aerosol-generating substrate according to Test Method A, an aerosol is generated that preferably comprises at least about 1 microgram of 12-O-methylcarnosol per gram of the substrate, on a dry weight basis.

Preferably, the aerosol generated from an aerosol-generating substrate according to the present invention comprises at least about 10 micrograms of 12-O-methylcarnosol per gram of the substrate, on a dry weight basis. Even more preferably, the aerosol generated from an aerosol-generating substrate according to the present invention comprises at least about 25 micrograms of 12-O-methylcarnosol per gram of the substrate, on a dry weight basis. Alternatively, or in addition, the aerosol generated from the aerosol-generating substrate preferably comprises up to about 150 micrograms of 12-O-methylcarnosol per gram of the substrate, on a dry weight basis. More preferably, the aerosol generated from the aerosol-generating substrate comprises up to about 120 micrograms of 12-O-methylcarnosol per gram of the substrate, on a dry weight basis. Even more preferably, the aerosol generated from the aerosol-generating substrate comprises up to about 100 micrograms of 12-O-methylcarnosol per gram of the substrate, on a dry weight basis.

In some embodiments, the aerosol generated from an aerosol-generating substrate according to the present invention comprises at least 30 micrograms of betulinic acid per gram of the substrate, on a dry weight basis; at least 1 microgram of rosmaridiphenol per gram of the substrate, on a dry weight basis; and at least 1 microgram of 12-O-methylcarnosol per gram of the substrate, on a dry weight basis.

Preferably, the aerosol produced from an aerosol-generating substrate according to the present invention during Test Method A further comprises at least about 0.1 micrograms of nicotine per gram of the substrate, more preferably at least about 1 microgram of nicotine per gram of the substrate, more preferably at least about 2 micrograms of nicotine per gram of the substrate. Preferably, the aerosol comprises up to about 10 micrograms of nicotine per gram of the substrate, more preferably up to about 7.5 micrograms of nicotine per gram of the substrate, more preferably up to about 4 micrograms of nicotine per gram of the substrate. For example, the aerosol may comprise between about 0.1 micrograms and about 10 micrograms of nicotine per gram of the substrate, or between about 1 microgram and about 7.5 micrograms of nicotine per gram of the substrate, or between about 2 micrograms and about 4 micrograms of nicotine per gram of the substrate. In some embodiments of the present invention, the aerosol may contain zero micrograms of nicotine.

Various methods known in the art can be applied to measure the amount of nicotine in the aerosol.

Alternatively or in addition, the aerosol produced from an aerosol-generating substrate according to the present invention during Test Method A may optionally further comprise at least about 20 milligrams of a cannabinoid compound per gram of the substrate, more preferably at least about 50 milligrams of a cannabinoid compound per gram of the substrate, more preferably at least about 100 milligrams of a cannabinoid compound per gram of the substrate. Preferably, the aerosol comprises up to about 250 milligrams of a cannabinoid compound per gram of the substrate, more preferably up to about 200 milligrams of a cannabinoid compound per gram of the substrate, more preferably up to about 150 milligrams of a cannabinoid compound per gram of the substrate. For example, the aerosol may comprise between about 20 milligrams and about 250 milligrams of a cannabinoid compound per gram of the substrate, or between about 50 milligrams and about 200 milligrams of a cannabinoid compound per gram of the substrate, or between about 100 milligrams and about 150 milligrams of a cannabinoid compound per gram of the substrate. In some embodiments of the present invention, the aerosol may contain zero micrograms of cannabinoid compound.

Preferably, the cannabinoid compound is selected from CBD and THC. More preferably, the cannabinoid compound is CBD.

Various methods known in the art can be applied to measure the amount of a cannabinoid compound in the aerosol.

Carbon monoxide may also be present in the aerosol generated from an aerosol-generating substrate according to the invention during Test Method A and may be measured and used to further characterise the aerosol. Oxides of nitrogen such as nitric oxide and nitrogen dioxide may also be present in the aerosol and may be measured and used to further characterise the aerosol.

According to the present invention, the aerosol generated from the aerosol-generating substrate during Test Method A preferably has an amount of betulinic acid per gram of the substrate that is preferably at least 5 times the amount of rosmaridiphenol per gram of the substrate.

More preferably, the amount of betulinic acid in the aerosol generated from the aerosol-generating substrate during Test Method A is at least 10 times the amount of rosmaridiphenol per gram of the substrate, such that the ratio of betulinic acid to rosmaridiphenol is at least 10 to 1. Even more preferably, the amount of betulinic acid in the aerosol generated from the aerosol-generating substrate during Test Method A is at least 20 times the amount of rosmaridiphenol per gram of the substrate, such that the ratio of betulinic acid to rosmaridiphenol is at least 20 to 1.

In preferred embodiments, the amount of betulinic acid in the aerosol generated from the aerosol-generating substrate during Test Method A is such that the ratio of betulinic acid to rosmaridiphenol is from 5 to 1 to 20 to 1.

The defined ratios of betulinic acid to rosmaridiphenol characterise an aerosol that is derived from rosemary particles. In contrast, in an aerosol produced from rosemary oil, the ratio of betulinic acid to rosmaridiphenol would be significantly different.

The presence of rosemary within an aerosol-generating substrate and the proportion of rosemary provided within an aerosol-generating substrate can be determined by measuring the amount of the characteristic compounds within the substrate and comparing this to the corresponding amount of the characteristic compound in pure rosemary material. The presence and amount of the characteristic compounds can be conducted using any suitable techniques, which would be known to the skilled person.

In a suitable technique, a sample of 250 milligrams of the aerosol-generating substrate is mixed with 5 millilitres of methanol and extracted by shaking, vortexing for 5 minutes and centrifuging (4500 g, 5 minutes, 10 degrees Celsius). Aliquots (300 microlitres) of the extract are transferred into a silanized chromatographic vial and diluted with methanol (600 microlitres) and internal standard (ISTD) solution (100 microlitres). The vials are closed and mixed for 5 minutes using an Eppendorf ThermoMixer (5 degrees Celsius; 2000 rpm). Test samples from the resultant extract are analysed by LC-HRAM-MS in combined full scan mode and data dependent fragmentation mode for identification of the characteristic compounds.

In alternative embodiments, the non-tobacco plant particles comprise clove particles. As is known, cloves are effectively dried flower buds and stems of *Syzygium aromaticum*, a tree in the family Myrtaceae, and are commonly used as a spice. Accordingly, each clove comprises a calyx of sepals and a corolla of unopened petals, which form a ball-like portion attached to the calyx. As used herein, the term "clove particles" encompasses particles derived from *Syzygium aromaticum* buds and stems and may include whole cloves, ground or crushed cloves, or cloves that have been otherwise physically processed to reduce the particle size.

As a result of the inclusion of the clove particles, the aerosol-generating substrate comprises certain proportions of the "characteristic compounds" of clove. Characteristic compounds unique to clove include but are not limited to: eugenol-acetate (Chemical Abstracts Service Registry Number 93-28-7), and beta-caryophyllene (Chemical Abstracts Service Registry Number 87-44-5) and eugenol. In particular, the aerosol-generating substrate comprises at least about 125 micrograms of eugenol per gram of the substrate, at least about 125 micrograms of eugenol-acetate per gram of the substrate and at least about 1 microgram of beta-caryophyllene per gram of the substrate, on a dry weight basis.

Preferably, the ratio of the characteristic compounds in the aerosol-generating substrate is such that the amount of eugenol per gram of the substrate is no more than 3 times the amount of eugenol-acetate per gram of the substrate, more preferably no more than twice the amount of eugenol-acetate per gram of the substrate, on a dry weight basis. Alternatively or in addition, the amount of eugenol per gram of the substrate is at least 50 times the amount of beta-caryophyllene per gram of the substrate, on a dry weight basis. These ratios of eugenol to eugenol acetate and beta-caryophyllene are characteristic of the inclusion of clove particles. In contrast, in clove oil the ratio of eugenol to eugenol-acetate would be significantly higher whilst the ratio of eugenol to beta-caryophyllene would be significantly lower.

In alternative embodiments, the non-tobacco plant particles comprise star anise particles. As used herein, the term "star anise particles" encompasses particles derived from the dried fruits of plants of the genus *Illicium*, preferably particles derived from *Illicium verum* Hooker fil. (Illiciaceae).

As a result of the inclusion of the star anise particles, the aerosol-generating substrate comprises certain proportions of the "characteristic compounds" of star anise. Characteristic compounds unique to star anise include but are not limited to: (E)-anethole, epoxyanethole and benzyl isoeugenol ether. In particular, the aerosol-generating substrate comprises at least about 70 micrograms of (E)-anethole per gram of the substrate, at least about 50 micrograms of epoxyanethole per gram of the substrate and at least about 130 micrograms of benzyl isoeugenol ether per gram of the substrate, on a dry weight basis.

Preferably, the ratio of the characteristic compounds in the aerosol-generating substrate is such that the amount of (E)-anethole per gram of the substrate is no more than 5 times the amount of epoxyanethole per gram of the substrate, more preferably no more than 3 times the amount of epoxyanethole per gram of the substrate, on a dry weight basis. This ratio of (E)-anethole to epoxyanethole is significantly lower than the corresponding ratio in star anise oil and is characteristic of the inclusion of star anise particles in the aerosol-generating substrate. In contrast, star anise oil typically comprises no more than a trace amount of epoxyanethole and a relatively high proportion of (E)-anethole.

In alternative embodiments, the non-tobacco plant particles comprise ginger particles. As used herein, the term "ginger particles" encompasses particles derived from the dried root of plants of the genus *Zingiber*, preferably particles derived from *Zingiber officinale* Rosc. (Zingiberaceae).

As a result of the inclusion of the ginger particles, the aerosol-generating substrate comprises certain proportions of the "characteristic compounds" of ginger. Characteristic compounds unique to ginger include but are not limited to: [10]-shogaol (1-(4-Hydroxy-3-methoxyphenyl)tetradec-4-en-3-one), [8]-shogaol (1-(4-Hydroxy-3-methoxyphenyl) dodec-4-en-3-one), [6]-shogaol (1-(4-Hydroxy-3-methoxyphenyl)dec-4-en-3-one), [6]-gingerol ((S)-5-Hydroxy-1-(4-hydroxy-3-methoxyphenyl)-3-decanone), and [10]-gingerol ((S)-5-Hydroxy-1-(4-hydroxy-3-methoxyphenyl)-3-tetradecanone). In particular, the aerosol-generating substrate comprises at least about 10 micrograms of [6]-gingerol per gram of the substrate, at least about 90 micrograms of [10]-gingerol per gram of the substrate, at least about 70 micrograms of [10]-shogaol per gram of the substrate, at least about 30 micrograms of [8]-shogaol per gram of the substrate and at least about 80 micrograms of [6]-shogaol per gram of the substrate, on a dry weight basis.

Preferably, the ratio of the characteristic compounds in the aerosol-generating substrate is such that the amount of [6]-shogaol per gram of the substrate is at least 5 times the amount of [6]-gingerol per gram of the substrate, more preferably at least 7.5 times the amount of [6]-gingerol per gram of the substrate, on a dry weight basis. In contrast, ginger oil typically comprises a level of [6]-gingerol that is similar to or higher than the level of [6]-shogaol.

In alternative embodiments, the non-tobacco plant particles comprise *eucalyptus* particles. As used herein, the term "*eucalyptus* particles" encompasses particles derived from plants of the genus *Eucalyptus*, preferably particles derived from one or more of *E. globulus, E. radiata, E. citriodora* and *E. smithii*, most preferably particles derived from *E. globulus*, such as ground or powdered *eucalyptus* leaf lamina, and ground or powdered *eucalyptus* leaf stems. *Eucalyptus* leaf particles are made exclusively from the leaf of *eucalyptus* plant. *Eucalyptus* stem particles are made exclusively from the stem of the leaf of *eucalyptus* plant. The *eucalyptus* particles in the aerosol-generating substrate of the present invention may comprise either *eucalyptus* leaf particles, *eucalyptus* stem particles, or both *eucalyptus* leaf particles and *eucalyptus* stem particles.

As a result of the inclusion of the *eucalyptus* particles, the aerosol-generating substrate comprises certain proportions of the "characteristic compounds" of *eucalyptus*. Characteristic compounds unique to *eucalyptus* include but are not limited to: eucalyptin, 8-desmethyleucalyptin and eucalyptol. In particular, the aerosol-generating substrate comprises at least about 0.04 mg of eucalyptol per gram of the substrate, at least about 0.2 mg of eucalyptin per gram of the substrate and at least about 0.2 mg of 8-desmethyleucalyptin per gram of the substrate, on a dry weight basis.

Preferably, the ratio of the characteristic compounds in the aerosol-generating substrate is such that the amount of eucalyptin per gram of the substrate is at least 3 times the amount of eucalyptol per gram of the substrate, more preferably at least 4 times the amount of eucalyptol per gram of the substrate, on a dry weight basis. Alternatively or in addition, the amount of 8-desmethyleucalyptin per gram of the substrate is at least 3 times the amount of eucalyptol per gram of the substrate, on a dry weight basis. The presence of eucalyptin and 8-desmethyleucalyptin at significantly higher levels than eucalyptol is characteristic of the inclusion of *eucalyptus* particles. In contrast, *eucalyptus* oil comprises levels of eucalyptol which are significantly higher than the levels of eucalyptin and 8-desmethyleucalyptin.

In embodiments in which the homogenised plant material comprises tobacco particles, the aerosol-generating substrate comprises certain proportions of the "characteristic compounds" of tobacco. Characteristic compounds generated from tobacco include but are not limited to cotinine, and damascenone. In particular, the aerosol-generating substrate preferably comprises at least about 60 micrograms of cotinine per gram of the substrate and at least about 10 micrograms of damascenone per gram of the substrate.

The composition of the homogenised plant material can advantageously be adjusted through the blending of desired amounts and types of the different plant particles. This enables an aerosol-generating substrate to be formed from a single homogenised plant material, if desired, without the need for the combination or mixing of different blends, as is the case for example in the production of conventional cut filler. The production of the aerosol-generating substrate can therefore potentially be simplified.

The particulate plant material used in the aerosol-generating substrates of the present invention may be adapted to provide a desired particle size distribution. Particle size distributions herein are stated as D-values, whereby the D-value refers to the percentage of particles by number that has a diameter of less than or equal to the given D-value. For instance, in a D95 particle size distribution, 95 percent of the particles by number are of a diameter less than or equal to the given D95 value, and 5 percent of the particles by number are of a diameter measuring greater than the given D95 value. Similarly, in a D5 particle size distribution, 5 percent of the particles by number are of a diameter less than or equal to the D5 value, and 95 percent of the particles by number are of a diameter greater than the given D5 value. In combination, the D5 and D95 values therefore provide an indication of the particle size distribution of the particulate plant material.

The particulate plant material may have a D95 value of from greater than or equal to 50 microns to a D95 value of less than or equal to 400 microns. By this is meant that the particulate plant material may be of a distribution represented by any D95 value within the given range, that is D95 may be equal to 50 microns, or D95 may be equal to 55 microns, et cetera, all the way up to D95 may be equal to 400 microns. By providing a D95 value within this range, the inclusion of relatively large plant particles into the homogenised plant material is avoided. This is desirable, since the generation of aerosol from such large plant particles is likely to be relatively inefficient. Furthermore, the inclusion of large plant particles in the homogenised plant material may adversely impact the consistency of the material.

Preferably the particulate plant material may have a D95 value of from greater than or equal to about 50 microns to a D95 value of less than or equal to about 350 microns, more preferably a D95 value of from greater than or equal to about 100 microns to a D95 value of less than or equal to about 300 microns. The particulate non-tobacco material and the particulate tobacco material may both have D95 values of from greater than or equal to about 50 microns to D95 values of less than or equal to about 400 microns, preferably D95 values of from greater than or equal to 100 microns to D95 values of less than or equal to about 350 microns, more preferably D95 values of from greater than or equal to about 200 microns to D95 values of less than or equal to about 300 microns.

Preferably, the particulate plant material may have a D5 value of from greater than or equal to about 10 microns to a D5 value of less than or equal to about 50 microns, more preferably a D5 value of from greater than or equal to about 20 microns to a D5 value of less than or equal to about 40 microns. By providing a D5 value within this range, the inclusion of very small dust particles into the homogenised plant material is avoided, which may be desirable from a manufacturing point of view.

Preferably, the maximum particle size of the particulate plant material is about 250 microns, more preferably about 200 microns.

In some embodiments, the particulate plant material may be purposely ground to form particles having the desired particle size distribution. The use of purposely ground plant material advantageously improves the homogeneity of the particulate plant material and the consistency of the homogenised plant material.

The diameter of 100 percent of the particulate plant material may be less than or equal to about 500 microns, more preferably less than or equal to about 450 microns. The diameter of 100 percent of the particulate non-tobacco plant material and 100 percent of the particulate tobacco material may be less than or equal to about 500 microns, more preferably less than or equal to about 450 microns. The particle size range of the non-tobacco particles enables them to be combined with tobacco particles in existing cast leaf processes.

In addition to the components described above, the homogenised plant material may optionally further comprise one or more lipids to facilitate the diffusivity of volatile components (for example, aerosol formers, (E)-anethole and nicotine), wherein the lipid is included in the homogenised plant material during manufacturing as described herein. Suitable lipids for inclusion in the homogenised plant material include, but are not limited to: medium-chain triglycerides, cocoa butter, palm oil, palm kernel oil, mango oil, shea butter, soybean oil, cottonseed oil, coconut oil, hydrogenated coconut oil, candelilla wax, carnauba wax, shellac, sunflower wax, sunflower oil, rice bran, and Revel A; and combinations thereof.

Alternatively or in addition, the homogenised plant material may further comprise a pH modifier.

The homogenised plant material is preferably in the form of a solid or a gel. However, in some embodiments the homogenised material may be in the form of a solid that is not a gel. Preferably, the homogenised material is not in the form of a film.

The homogenised plant material can be provided in any suitable form. For example, the homogenised plant material may be in the form of one or more sheets. As used herein with reference to the invention, the term "sheet" describes a laminar element having a width and length substantially greater than the thickness thereof.

Alternatively or in addition, the homogenised plant material may be in the form of a plurality of pellets or granules.

Alternatively or in addition, the homogenised plant material may be in a form that can fill a cartridge or a shisha consumable, or that can be used in a shisha device. The invention includes a cartridge or a shisha device that contains a homogenised plant material.

Alternatively or in addition, the homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

In some embodiments, the strands may be formed in situ within the aerosol-generating substrate as a result of the splitting or cracking of a sheet of homogenised plant material during formation of the aerosol-generating substrate, for example, as a result of crimping. The strands of homogenised plant material within the aerosol-generating substrate may be separate from each other. Alternatively, each strand of homogenised plant material within the aerosol-generating substrate may be at least partially connected to an adjacent strand or strands along the length of the strands. For example, adjacent strands may be connected by one or more fibers. This may occur, for example, where the strands have been formed due to the splitting of a sheet of homogenised plant material during production of the aerosol-generating substrate, as described above.

Preferably, the aerosol-generating substrate is in the form of one or more sheets of homogenised plant material. In various embodiments of the invention, the one or more sheets of homogenised plant material may be produced by a casting process. The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the aerosol-generating substrate is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 $g/m^2$ and about 300 $g/m^2$.

The one or more sheets as described herein may each individually have a density of from about 0.3 $g/cm^3$ to about 1.3 $g/cm^3$, and preferably from about 0.7 $g/cm^3$ to about 1.0 $g/cm^3$.

The term "tensile strength" is used throughout the specification to indicate a measure of the force required to stretch a sheet of homogenised plant material until it breaks. More specifically, the tensile strength is the maximum tensile force per unit width that the sheet material will withstand before breaking and is measured in the machine direction or cross direction of the sheet material. It is expressed in units of Newtons per meter of material (N/m). Tests for measuring the tensile strength of a sheet material are well known. A suitable test is described in the 2014 publication of the International Standard ISO 1924-2 entitled "Paper and Board—Determination of Tensile Properties—Part 2: Constant Rate of Elongation Method".

The materials and equipment required to conduct a test according to ISO 1924-2 are: a universal tensile/compression testing machine, Instron 5566, or equivalent; a tension load cell of 100 Newtons, Instron, or equivalent; two pneumatic action grips; a steel gauge block of 180±0.25 millimetres length (width: about 10 millimetres, thickness: about 3 millimetres); a double-bladed strip cutter, size 15±0.05× about 250 millimetres, Adamel Lhomargy, or equivalent; a scalpel; a computer running acquisition software, Merlin, or equivalent; and compressed air.

The sample is prepared by first conditioning the sheet of homogenised plant material for at least 24 hours at 22±2 degrees Celsius and 60±5% relative humidity before testing. A machine-direction or cross-direction sample is then cut to about 250×15±0.1 millimetres with the double-bladed strip cutter. The edges of the test pieces must be cut cleanly, so no more than three test specimens are cut at the same time.

The tensile/compression testing instrument is set up by installing the tension load cell of 100 Newtons, switching on the Universal Tensile/Compression Testing Machine and the computer, and selecting the measurement method predefined in the software, with a test speed set to 8 millimetres per minute. The tension load cell is then calibrated and the pneumatic action grips are installed. The test distance between the pneumatic action grips is adjusted to 180±0.5 millimetres by means of the steel gauge block, and the distance and force are set to zero.

The test specimen is then placed straight and centrally between the grips, and touching the area to be tested with fingers is avoided. The upper grip is closed and the paper strip hangs in the opened lower grip. The force is set to zero. The paper strip is then pulled lightly down and the lower grip is closed; the starting force must be between 0.05 and 0.20 Newtons. While the upper grip is moving upward, a gradually increasing force is applied until the test specimen breaks. The same procedure is repeated with the remaining test specimens. The result is valid when the test specimen breaks when the grips move apart by a distance of more than 10 millimetres. If it is not the case, the result is rejected and an additional measurement is performed.

The one or more sheets of homogenised plant material as described herein may each individually have a tensile strength at peak in a cross direction of from 50 N/m to 400 N/m or preferably from 150 N/m to 350 N/m. Given that the sheet thickness affects the tensile strength, and where a batch of sheets exhibits variation in thickness, it may be desirable to normalize the value to a specific sheet thickness.

Where the test specimen of homogenised plant material that is available is smaller than the described sample in the test according to ISO 1924-2, as set out above, the test can readily be scaled down to accommodate the available size of test specimen.

The one or more sheets as described herein may each individually have a tensile strength at peak in a machine direction of from 100 N/m to 800 N/m or preferably from 280 N/m to 620 N/m, normalized to a sheet thickness of 215 μm. The machine direction refers to the direction in which the sheet material would be rolled onto or unrolled from a bobbin and fed into a machine, while the cross direction is perpendicular to the machine direction. Such values of tensile strength make the sheets and methods described herein particularly suitable for subsequent operations involving mechanical stresses.

The provision of a sheet having the levels of thickness, grammage and tensile strength as defined above advantageously optimises the machinability of the sheet to form the aerosol-generating substrate and ensures that damage, such as tearing of the sheet, is avoided during high speed processing of the sheet.

In embodiments of the present invention in which the aerosol-generating substrate comprises one or more sheets of homogenised plant material, the sheets are preferably in the form of one or more gathered sheets. As used herein, the term "gathered" denotes that the sheet of homogenised plant material is convoluted, folded, or otherwise compressed or constricted substantially transversely to the cylindrical axis of a plug or a rod. As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis. As used herein, the term "length" refers to the dimension of a component in the longitudinal direction and the term "width" refers to the dimension of a component in the transverse direction. For example, in the case of a plug or rod having a circular cross-section, the maximum width corresponds to the diameter of the circle.

As used herein, the term "plug" denotes a generally cylindrical element having a substantially polygonal, circular, oval or elliptical cross-section. As used herein, the term "rod" refers to a generally cylindrical element of substantially polygonal cross-section and preferably of circular, oval or elliptical cross-section. A rod may have a length greater than or equal to the length of a plug. Typically, a rod has a length that is greater than the length of a plug. A rod may comprise one or more plugs, preferably aligned longitudinally.

As used herein, the terms "upstream" and "downstream" describe the relative positions of elements, or portions of elements, of the aerosol-generating article in relation to the direction in which the aerosol is transported through the aerosol-generating article during use. The downstream end of the airflow path is the end at which aerosol is delivered to a user of the article.

The one or more sheets of homogenised plant material may be gathered transversely relative to the longitudinal axis thereof and circumscribed with a wrapper to form a continuous rod or a plug. The continuous rod may be severed into a plurality of discrete rods or plugs. The wrapper may be a paper wrapper or a non-paper wrapper, as described in more detail below.

Alternatively, the one or more sheets of homogenised plant material may be cut into strands as referred to above. In such embodiments, the aerosol-generating substrate comprises a plurality of strands of the homogenised plant material. The strands may be used to form a plug. Typically, the width of such strands is at least about 0.2 mm, or at least about 0.5 mm. Preferably, the width of such strands is no more than about 5 mm, or about 4 mm, or about 3 mm, or about 1.5 mm. For example, the width of the strands may be between about 0.25 mm and about 5 mm, or between about 0.25 mm and about 3 mm, or between about 0.5 mm and about 1.5 mm.

The length of the strands is preferably greater than about 5 mm, for example, between about 5 mm to about 15 mm, about 8 mm to about 12 mm, or about 12 mm. Preferably, the strands have substantially the same length as each other. The length of the strands may be determined by the manufacturing process whereby a rod is cut into shorter plugs and the length of the strands corresponds to the length of the plug. The strands may be fragile which may result in breakage especially during transit. In such cases, the length of some of the strands may be less than the length of the plug.

The plurality of strands preferably extend substantially longitudinally along the length of the aerosol-generating substrate, aligned with the longitudinal axis. Preferably, the plurality of strands are therefore aligned substantially parallel to each other. The plurality of longitudinal strands of homogenised plant material is preferably substantially non-coiled.

The strands of homogenised plant material preferably each have a mass to surface area ratio of at least about 0.02 milligrams per square millimetre, more preferably at least about 0.05 milligrams per square millimetre. Preferably the strands of homogenised plant material each have a mass to surface area ratio of no more than about 0.2 milligrams per square millimetre, more preferably no more than about 0.15 milligrams per square millimetre. The mass to surface area ratio is calculated by dividing the mass of the strand of homogenised plant material in milligrams by the geometric surface area of the strand of homogenised plant material in square millimetres.

The one or more sheets of homogenised plant material may be textured through crimping, embossing, or perforating. The one or more sheets may be textured prior to gathering or prior to being cut into strands. Preferably, the one or more sheets of homogenised plant material are crimped prior to gathering, such that the homogenised plant material may be in the form of a crimped sheet, more preferably in the form of a gathered crimped sheet. As used herein, the term "crimped sheet" denotes a sheet having a plurality of substantially parallel ridges or corrugations usually aligned with the longitudinal axis of the article.

In one embodiment, the aerosol-generating substrate may be in the form of a single plug of aerosol-generating substrate. Preferably, the plug of aerosol-generating substrate may comprise a plurality of strands of homogenised plant material. Most preferably, the plug of aerosol-generating substrate may comprise one or more sheets of homogenised plant material. Preferably, the one or more sheets of homogenised plant material may be crimped such that it has a plurality of ridges or corrugations substantially parallel to the cylindrical axis of the plug. This treatment advantageously facilitates gathering of the crimped sheet of homogenised plant material to form the plug. Preferably, the one or more sheets of homogenised plant material may be gathered. It will be appreciated that crimped sheets of homogenised plant material may alternatively or in addition have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

In another embodiment, the aerosol-generating substrate comprises a first plug comprising a first homogenised plant material and a second plug comprising a second homogenised plant material, wherein the first homogenised plant material and the second homogenised plant material are different to each other. Two or more plugs may be combined in an abutting end-to-end relationship and extend to form a rod. Two plugs may be placed longitudinally with a gap between them, thereby creating a cavity within a rod. The plugs may be in any suitable arrangement within the rod.

The homogenised plant material used in the aerosol-generating substrates according to the invention may be produced by various methods including paper making, casting, dough reconstitution, extrusion or any other suitable process.

In certain preferred embodiments of the present invention, the homogenised plant material is in the form of cast leaf. The term "cast leaf" is used herein to refer to a sheet product made by a casting process that is based on casting a slurry comprising plant particles (for example, non-tobacco particles, or tobacco particles and non-tobacco particles in a mixture) and a binder onto a supportive surface, such as a belt conveyor, drying the slurry and removing the dried sheet from the supportive surface. An example of the casting or cast leaf process is described in, for example, U.S. Pat. No. 5,724,998 for making cast leaf tobacco. In a cast leaf process, particulate plant materials are mixed with a liquid component, typically water, to form a slurry. Other added components in the slurry may include fibers, a binder and an aerosol former. The particulate plant materials may be agglomerated in the presence of the binder. The slurry is cast onto a supportive surface and dried to form a sheet of homogenised plant material.

In certain preferred embodiments, the homogenised plant material used in articles according to the present invention is produced in a casting process. Homogenised plant material made by the casting process typically comprise agglomerated particulate plant material.

In a cast-leaf process, because substantially all the soluble fraction is kept within the plant material, most flavours are advantageously preserved. Additionally, energy-intensive paper-making steps are avoided.

The present invention further provides methods of making an aerosol-generating substrate comprising the homogenised plant material as defined above. In a first step of the method, a mixture comprising particulate plant material, water, an aerosol former, cellulose ether and additional cellulose is formed. A sheet is formed from the mixture, and the sheet is then dried. Preferably the mixture is an aqueous mixture. As used herein, "dry weight" refers to the weight of a particular non-water component relative to the sum of the weights of all non-water components in a mixture, expressed as a percentage. The composition of aqueous mixtures may be referred to by "percentage dry weight." This refers to the weight of the non-water components relative to the weight of the entire aqueous mixture, expressed as a percentage.

Preferably, the cellulose ether is dispersed within the aerosol former and the dispersion of cellulose ether and aerosol former is added to a mixture of the non-tobacco plant particles in water The mixture may be a slurry. As used herein, a "slurry" is a homogenised aqueous mixture with a relatively low dry weight. A slurry as used in the method herein may preferably have a dry weight of between 5 percent and 60 percent.

Alternatively, the mixture may be a dough. As used herein, a "dough" is an aqueous mixture with a relatively high dry weight. A dough as used in the method herein may preferably have a dry weight of at least 60 percent, more preferably at least 70 percent.

Slurries comprising greater than 30 percent dry weight and doughs may be preferred in certain embodiments of the present method.

The step of mixing the particulate plant material, water and other components may be carried out by any suitable means. For mixtures of a low viscosity, that is, some slurries, it is preferred that mixing is performed using a high energy mixer or a high shear mixer. Such mixing breaks down and distributes the various phases of the mixture homogeneously. For mixtures of a higher viscosity, that is, some doughs, a kneading process may be used to distribute the various phases of the mixture homogeneously.

Methods according to the present invention may further comprise the step of vibrating the mixture to distribute the various components. Vibrating the mixture, that is for example vibrating a tank or silo where a homogenised mixture is present, may help the homogenization of the mixture, particularly when the mixture is a mixture of low viscosity, that is, some slurries. Less mixing time may be required to homogenize a mixture to the target value optimal for casting if vibrating is performed as well as mixing.

If the mixture is a slurry, a web of homogenised plant material is preferably formed by a casting process comprising casting the slurry on a supportive surface, such as a belt conveyor. The method for production of a homogenised plant material comprises the step of drying said cast web to form a sheet. The cast web may be dried at room temperature or at an ambient temperature of at least about 60 degrees Celsius, more preferably at least about 80 degrees Celsius for a suitable length of time. Preferably, the cast web is dried at an ambient temperature of no more than 200 degrees Celsius, more preferably no more than about 160 degrees Celsius. For example, the cast web may be dried at a temperature of between about 60 degrees Celsius and about 200 degrees Celsius, or between about 80 degrees Celsius and about 160 degrees Celsius. Preferably, the moisture content of the sheet after drying is between about 5 percent and about 15 percent based on the total weight of the sheet. The sheet may then be removed from the supportive surface after drying. The cast sheet has a tensile strength such that it can be mechanically manipulated and wound or unwound from a bobbin without breakage or deformation.

If the mixture is a dough, the dough may be extruded in the form of a sheet, strands, or strips, prior to the step of drying the extruded mixture. Preferably, the dough may be extruded in the form of a sheet. The extruded mixture may be dried at room temperature or at a temperature of at least about 60 degrees Celsius, more preferably at least about 80 degrees Celsius for a suitable length of time. Preferably, the cast web is dried at an ambient temperature of no more than 200 degrees Celsius, more preferably no more than about 160 degrees Celsius. For example, the cast web may be dried at a temperature of between about 60 degrees Celsius and about 200 degrees Celsius, or between about 80 degrees Celsius and about 160 degrees Celsius. Preferably, the moisture content of the extruded mixture after drying is between about 5 percent and about 15 percent based on the total weight of the sheet. A sheet formed from dough requires less drying time and/or lower drying temperatures as a result of significantly lower water content relative to a web formed from a slurry.

After the sheet has been dried, the method may optionally comprise a step of coating a nicotine salt, preferably along with an aerosol former, onto the sheet, as described in the disclosure of WO-A-2015/082652.

After the sheet has been dried, methods according to the invention may optionally comprise a step of cutting the sheet into strands, shreds or strips for the formation of the aerosol-generating substrate as described above. The strands, shreds or strips may be brought together to form a rod of the aerosol-generating substrate using suitable means. In the formed rod of aerosol-generating substrate, the strands, shreds or strips may be substantially aligned, for example, in the longitudinal direction of the rod. Alternatively, the strands, shreds or strips may be randomly oriented in the rod.

In certain preferred embodiments, the method further comprises a step of crimping the sheet. This may facilitate the gathering of the sheet to form a rod, as described below. The step of "crimping" produces a sheet having a plurality of ridges or corrugations.

In certain preferred embodiments, the method further comprises a step of gathering the sheet to form a rod. The term "gathered" refers to a sheet that is convoluted, folded, or otherwise compressed or constricted substantially transversely to the longitudinal axis of the aerosol-generating substrate. The step of "gathering" the sheet may be carried out by any suitable means which provides the necessary transverse compression of the sheet.

Methods according to the present invention may optionally further comprise a step of winding the sheet onto a bobbin, after the drying step.

Other known processes that can be applied to producing homogenised plant materials are dough reconstitution processes of the type described in, for example, U.S. Pat. No. 3,894,544; and extrusion processes of the type described in, for example, in GB-A-983,928. Typically, the densities of homogenised plant materials produced by extrusion processes and dough reconstitution processes are greater than the densities of the homogenised plant materials produced by casting processes.

Preferably, the aerosol-generating substrate of aerosol-generating articles according to the invention comprises at least about 200 mg of the homogenised plant material, more preferably at least about 250 mg of the homogenised plant material and more preferably at least about 300 mg of the homogenised plant material.

Aerosol-generating articles according to the invention comprise a rod comprising the substrate in one or more plugs. The rod of aerosol-generating substrate may have a length of from about 5 mm to about 120 mm. For example, the rod may preferably have a length of between about 10 and about 45 mm, more preferably between about 10 mm and 15 mm, most preferably about 12 mm.

In alternative embodiments, the rod preferably has a length of between about 30 mm and about 45 mm, or between about 33 mm and about 41 mm. Where the rod is formed of a single plug of aerosol-generating substrate, the plug has the same length as the rod.

The rod of aerosol-generating substrate may have an external diameter of between about 5 mm and about 10 mm, depending on their intended use. For example, in some embodiments, the rod may have an external diameter of between about 5.5 mm and about 8 mm, or between about 6.5 mm and about 8 mm. The "external diameter of the rod of aerosol-generating substrate corresponds to the diameter of the rod including any wrappers.

The rod of aerosol-generating substrate of the aerosol-generating articles according to the invention is preferably circumscribed by one or more wrappers along at least a part of its length. The one or more wrappers may include a paper wrapper or a non-paper wrapper, or both. Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to sheets of homogenised tobacco materials.

In certain embodiments of the invention, the aerosol-generating substrate is circumscribed along at least a part of its length by a thermally conductive sheet material, for example, a metallic foil, such as aluminium foil or a metallised paper. The metallic foil or metallised paper serves the purpose of conducting heat rapidly throughout the aerosol-generating substrate. In addition, the metallic foil or metallised paper may serve to prevent the ignition of the aerosol-generating substrate in the event that the consumer attempts to light it. Furthermore, during use, the metallic foil or metallised paper may prevent odours produced upon heating of the outer wrapper from entering the aerosol generated from the aerosol-generating substrate. For example, this may be a problem for aerosol-generating articles having an aerosol-generating substrate that is heated externally during use in order to generate an aerosol. Alternatively, or in addition, a metallised wrapper may be used to facilitate detection or recognition of the aerosol-generating article when it is inserted into an aerosol-generating device during use. The metallic foil or metallised paper may comprise metal particles, such as iron particles.

The one or more wrappers circumscribing the aerosol-generating substrate preferably have a total thickness of between about 0.1 mm and about 0.9 mm.

The internal diameter of the rod of aerosol-generating substrate is preferably between about 3 mm and about 9.5 mm, more preferably between about 4 mm and about 7.5 mm, more preferably between about 5 mm and about 7.5 mm. The "internal diameter" corresponds to the diameter of the rod of aerosol-generating substrate without including the thickness of the wrappers, but measured with the wrappers still in place.

Aerosol-generating articles according to the invention also include but are not limited to a cartridge or a shisha consumable.

Aerosol-generating articles according to the invention may optionally include a support element comprising at least one hollow tube immediately downstream of the aerosol-generating substrate. One function of the tube is to locate the aerosol-generating substrate towards the distal end of the aerosol-generating article so that it can be contacted with a heating element. The tube acts to prevent the aerosol-generating substrate from being forced along the aerosol-generating article towards other downstream elements when a heating element is inserted into the aerosol-generating substrate. The tube also acts as a spacer element to separate the downstream elements from the aerosol-generating substrate. The tube can be made of any material, such as cellulose acetate, a polymer, cardboard, or paper.

Alternatively or in addition, aerosol-generating articles according to the invention may optionally comprise an aerosol-cooling element downstream of the aerosol-generating substrate and immediately downstream of the hollow tube forming the support element. In use, an aerosol formed by volatile compounds released from the aerosol-generating substrate passes through and is cooled by the aerosol-cooling element before being inhaled by a user. The lower temperature allows the vapours to condense into an aerosol. The spacer or aerosol-cooling element may be a hollow tube, such as a hollow cellulose acetate tube or a cardboard tube, which can be similar to the support element that is immediately downstream of the aerosol-generating substrate. The aerosol-cooling element may be a hollow tube of equal outer diameter but smaller or larger inner diameter than the hollow tube of the support element.

In one embodiment, the aerosol-cooling element wrapped in paper comprises one or more longitudinal channels made of any suitable material, such as a metallic foil, a paper laminated with a foil, a polymeric sheet preferably made of a synthetic polymer, and a substantially non-porous paper or cardboard. In some embodiments, the aerosol-cooling element wrapped in paper may comprise one or more sheets made of a material selected from the group consisting of polyethylene (PE), polypropylene (PP), polyvinylchloride (PVC), polyethylene terephthalate (PET), polylactic acid (PLA), cellulose acetate (CA), paper laminated with a polymer sheet and aluminium foil. Alternatively, the aerosol-cooling element may be made of woven or non-woven filaments of a material selected from the group consisting of polyethylene (PE), polypropylene (PP), polyvinylchloride (PVC), polyethylene terephthalate (PET), polylactic acid (PLA), and cellulose acetate (CA). In a preferred embodiment, the aerosol-cooling element is a crimped and gathered sheet of polylactic acid wrapped within a filter paper. In another preferred embodiment, the aerosol-cooling element comprises a longitudinal channel and is made of woven filaments of a synthetic polymer, such as polylactic acid filaments, which are wrapped in paper.

One or more additional hollow tubes may be provided downstream of the aerosol-cooling element.

Aerosol-generating articles according to the invention may further comprise a filter or mouthpiece downstream of the aerosol-generating substrate and, where present, the support element and aerosol-cooling element. The filter may comprise one or more filtration materials for the removal of particulate components, gaseous components, or a combination thereof. Suitable filtration materials are known in the art and include, but are not limited to: fibrous filtration materials such as, for example, cellulose acetate tow and paper; adsorbents such as, for example, activated alumina, zeolites, molecular sieves and silica gel; biodegradable polymers including, for example, polylactic acid (PLA), Mater-Bi®, hydrophobic viscose fibers, and bioplastics; and combinations thereof. The filter may be located at the downstream end of the aerosol-generating article. The filter may be a cellulose acetate filter plug. The filter is about 7 mm in length in one embodiment, but may have a length of between about 5 mm and about 10 mm.

Aerosol-generating articles according to the invention may comprise a mouth end cavity at the downstream end of the article. The mouth end cavity may be defined by one or more wrappers extending downstream from the filter or mouthpiece. Alternatively, the mouth end cavity may be defined by a separate tubular element provided at the downstream end of the aerosol-generating article.

Aerosol-generating articles according to the invention preferably further comprise a ventilation zone provided at a location along the aerosol-generating article. For example, the aerosol-generating article may be provided at a location along a hollow tube provided downstream of the aerosol-generating substrate.

Aerosol-generating articles according to the invention may optionally further comprise an upstream element at the upstream end of the aerosol-generating substrate. The upstream element may be a porous plug element, such as a plug of fibrous filtration material such as cellulose acetate.

In preferred embodiments of the invention, the aerosol-generating article comprises the aerosol-generating substrate, at least one hollow tube downstream of the aerosol-generating substrate and a filter downstream of the at least one hollow tube. Optionally, the aerosol-generating article further comprises a mouth end cavity at the downstream end of the filter. Optionally, the aerosol-generating article further comprises an upstream element at the upstream end of the aerosol-generating substrate. Preferably, a ventilation zone is provided at a location along the at least one hollow tube.

In a particularly preferred embodiment having this arrangement, the aerosol-generating article comprises an aerosol-generating substrate, an upstream element at the upstream end of the aerosol-generating substrate, a support element downstream of the aerosol-generating substrate, an aerosol-cooling element downstream of the support element and a filter downstream of the aerosol-cooling element. Preferably, the support element and the aerosol-cooling element are both in the form of a hollow tube. Preferably, the aerosol-generating substrate comprises an elongate susceptor element extending longitudinally through it.

In one particularly preferred example, the aerosol-generating substrate has a length of about 33 mm and an external diameter of between about 5.5 mm and 6.7 mm, wherein the aerosol-generating substrate comprises about 340 mg of the homogenised plant material in the form of a plurality of strands, wherein the homogenised plant material comprises about 14 percent by weight glycerol on a dry weight basis. In this embodiment, the aerosol-generating article has a total length of about 74 mm and comprises a cellulose acetate tow filter having a length of about 10 mm, as well as a mouth end cavity defined by a hollow tube having a length of about 6-7 mm. The aerosol-generating article comprises a hollow tube downstream of the aerosol-generating substrate, wherein the hollow tube has a length of about 25 mm and is provided with a ventilation zone.

The aerosol-generating articles according to the invention may have a total length of at least about 30 mm, or at least about 40 mm. The total length of the aerosol-generating article may be less than 90 mm, or less than about 80 mm.

In one embodiment, the aerosol-generating article has a total length of between about 40 mm and about 50 mm, preferably about 45 mm. In another embodiment, the aerosol-generating article has a total length of between about 70 mm and about 90 mm, preferably between about 80 mm and about 85 mm. in another embodiment, the aerosol-generating article has a total length of between about 72 mm and about 76 mm, preferably about 74 mm.

The aerosol-generating article may have an external diameter of about 5 mm to about 8 mm, preferably between about 6 mm and about 8 mm. In one embodiment, the aerosol-generating article has an external diameter of about 7.3 mm.

Aerosol-generating articles according to the invention may further comprise one or more aerosol-modifying elements. An aerosol-modifying element may provide an aerosol-modifying agent. As used herein, the term aerosol-modifying agent is used to describe any agent that, in use, modifies one or more features or properties of aerosol passing through the filter. Suitable aerosol-modifying agents include, but are not limited to, agents that, in use, impart a taste or aroma to aerosol passing through the filter, or agents that, in use, remove flavors from the aerosol passing through the filter.

An aerosol-modifying agent may be one or more of moisture or a liquid flavourant. Water or moisture may modify the sensorial experience of the user, for example by moistening the generated aerosol, which may provide a cooling effect on the aerosol and may reduce the perception of harshness experienced by the user. An aerosol-modifying element may be in the form of a flavour-delivery element to deliver one or more liquid flavourants. Alternatively, a liquid flavorant may be added directly to the homogenised rosemary material, for example, by adding the flavour to the slurry or feedstock during production of the homogenised rosemary material, or by spraying the liquid flavourant onto the surface of the homogenised rosemary material.

The one or more liquid flavourants may comprise any flavour compound or botanical extract suitable for being releasably disposed in liquid form within the flavour-delivery element to enhance the taste of aerosol produced during use of the aerosol-generating article. The flavourants, liquid or solid, can also be disposed directly in the material which forms the filter, such as cellulose acetate tow. Suitable flavours or flavourings include, but are not limited to, menthol, mint, such as peppermint and spearmint, chocolate, liquorice, citrus and other fruit flavours, gamma octalactone, vanillin, ethyl vanillin, breath freshener flavours, spice flavours such as cinnamon, methyl salicylate, linalool, eugenol, bergamot oil, geranium oil, lemon oil, *cannabis* oil, and tobacco flavour. Other suitable flavours may include flavour compounds selected from the group consisting of an acid, an alcohol, an ester, an aldehyde, a ketone, a pyrazine, combinations or blends thereof and the like.

In certain embodiments of the invention, the aerosol-modifying agent may be an essential oil derived from one or more plants.

An aerosol-modifying agent may be an adsorbent material such as activated carbon, which removes certain constituents of the aerosol passing through the filter and thereby modifies the flavour and aroma of the aerosol.

The one or more aerosol-modifying elements may be located downstream of the aerosol-generating substrate or within the aerosol-generating substrate. The aerosol-generating substrate may comprise homogenised plant material and an aerosol-modifying element. In various embodiments, the aerosol-modifying element may be placed adjacent to the homogenised plant material or embedded in the homogenised plant material. Typically, aerosol-modifying elements may be located downstream of the aerosol-generating substrate, most typically, within the aerosol-cooling element, within the filter of the aerosol-generating article, such as within a filter plug or within a cavity, preferably within a cavity between filter plugs. The one or more aerosol-modifying elements may be in the form of one or more of a thread, a capsule, a microcapsule, a bead or a polymer matrix material, or a combination thereof.

If an aerosol-modifying element is in the form of a thread, as described in WO-A-2011/060961, the thread may be formed from paper such as filter plug wrap, and the thread may be loaded with at least one aerosol-modifying agent and located within the body of the filter. Other materials that can be used to form a thread include cellulose acetate and cotton.

If an aerosol-modifying element is in the form of a capsule, as described in WO-A-2007/010407, WO-A-2013/068100 and WO-A-2014/154887, the capsule may be a breakable capsule located within the filter, the inner core of the capsule containing an aerosol-modifying agent which may be released upon breakage of the outer shell of the capsule when the filter is subjected to external force. The capsule may be located within a filter plug or within a cavity, preferably a cavity between filter plugs.

If an aerosol-modifying element is in the form of a polymer matrix material, the polymer matrix material releases the flavourant when the aerosol-generating article is heated, such as when the polymer matrix is heated above the melting point of the polymer matrix material as described in WO-A-2013/034488. Typically, such polymer matrix material may be located within a bead within the aerosol-generating substrate. Alternatively, or in addition, the flavourant may be trapped within the domains of a polymer matrix material and releasable from the polymer matrix material upon compression of the polymer matrix material. Preferably, the flavorant is released upon compression of the polymer matrix material with a force of around 15 Newtons. Such flavour-modifying elements may provide a sustained release of the liquid flavourant over a range of force of at least 5 Newtons, such as between 5N and 20N, as described in WO2013/068304. Typically, such polymer matrix material may be located within a bead within the filter.

The aerosol-generating article may comprise a combustible heat source and an aerosol-generating substrate downstream of the combustible heat source, the aerosol-generating substrate as described above with respect to the first aspect of the invention.

For example, substrates as described herein may be used in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that substrates as described herein may also be used in heated aerosol-generating articles comprising combustible heat sources having other constructions.

The present invention provides an aerosol-generating system comprising an aerosol-generating device comprising a heating element, and an aerosol-generating article for use with the aerosol-generating device, the aerosol-generating article comprising the aerosol-generating substrate as described above.

In a preferred embodiment, aerosol-generating substrates as described herein may be used in heated aerosol-generating articles for use in electrically-operated aerosol-generating systems in which the aerosol-generating substrate of the heated aerosol-generating article is heated by an electrical heat source.

For example, aerosol-generating substrates as described herein may be used in heated aerosol-generating articles of the type disclosed in EP-A-0 822 760.

The heating element of such aerosol-generating devices may be of any suitable form to conduct heat. The heating of the aerosol-generating substrate may be achieved internally, externally or both. The heating element may preferably be a heater blade or pin adapted to be inserted into the substrate so that the substrate is heated from inside. Alternatively, the heating element may partially or completely surround the substrate and heat the substrate circumferentially from the outside.

The aerosol-generating system may be an electrically-operated aerosol generating system comprising an inductive heating device. Inductive heating devices typically comprise an induction source that is configured to be coupled to a susceptor, which may be provided externally to the aerosol-generating substrate or internally within the aerosol-generating substrate. The induction source generates an alternating electromagnetic field that induces magnetization or eddy currents in the susceptor. The susceptor may be heated as a result of hysteresis losses or induced eddy currents which heat the susceptor through ohmic or resistive heating.

Electrically operated aerosol-generating systems comprising an inductive heating device may also comprise the aerosol-generating article having the aerosol-generating substrate and a susceptor in thermal proximity to the aerosol-generating substrate. Typically, the susceptor is in direct contact with the aerosol-generating substrate and heat is transferred from the susceptor to the aerosol-generating substrate primarily by conduction. Examples of electrically operated aerosol-generating systems having inductive heating devices and aerosol-generating articles having susceptors are described in WO-A1-95/27411 and WO-A1-2015/177255.

A susceptor may be a plurality of susceptor particles which may be deposited on or embedded within the aerosol-generating substrate. When the aerosol-generating substrate is in the form of one or more sheets, a plurality of susceptor particles may be deposited on or embedded within the one or more sheets. The susceptor particles are immobilized by the substrate, for example, in sheet form, and remain at an initial position. Preferably, the susceptor particles may be homogeneously distributed in the homogenised plant material of the aerosol-generating substrate. Due to the particulate nature of the susceptor, heat is produced according to the distribution of the particles in the homogenised plant material sheet of the substrate. Alternatively, the susceptor in the form of one or more sheets, strips, shreds or rods may also be placed next to the homogenised plant material or used as embedded in the homogenised plant material. In one embodiment, the aerosol forming substrate comprises one or more susceptor strips. For example, the rod of aerosol-generating substrate may comprise an elongate susceptor element extending longitudinally through it. In another embodiment, the susceptor is present in the aerosol-generating device.

The susceptor may have a heat loss of more than 0.05 Joule per kilogram, preferably a heat loss of more than 0.1 Joule per kilogram. Heat loss is the capacity of the susceptor to transfer heat to the surrounding material. Because the susceptor particles are preferably homogeneously distributed in the aerosol-generating substrate, a uniform heat loss from the susceptor particles may be achieved thus generating a uniform heat distribution in the aerosol-generating substrate and leading to a uniform temperature distribution in the aerosol-generating article. It has been found that a specific minimal heat loss of 0.05 Joule per kilogram in the susceptor particles allows for heating of the aerosol-generating substrate to a substantially uniform temperature, thus providing aerosol generation. Preferably, the average temperatures achieved within the aerosol-generating substrate in such embodiments are about 200 degree Celsius to about 240 degrees Celsius.

Reducing the risk of overheating the aerosol-generating substrate may be supported by the use of susceptor materials having a Curie temperature, which allows a heating process due to hysteresis loss only up to a certain maximum temperature. The susceptor may have a Curie temperature between about 200 degree Celsius and about 450 degree Celsius, preferably between about 240 degree Celsius and about 400 degree Celsius, for example about 280 degree Celsius. When a susceptor material reaches its Curie temperature, the magnetic properties change. At the Curie temperature the susceptor material changes from a ferromagnetic phase to a paramagnetic phase. At this point, heating based on energy loss due to orientation of ferromagnetic domains stops. Further heating is then mainly based on eddy current formation such that a heating process is automatically reduced upon reaching the Curie temperature of the susceptor material. Preferably, susceptor material and its Curie temperature are adapted to the composition of the aerosol-generating substrate in order to achieve an optimal temperature and temperature distribution in the aerosol-generating substrate for an optimum aerosol generation.

In some preferred embodiments of the aerosol-generating article according to the invention, the susceptor is made of ferrite. Ferrite is a ferromagnet with a high magnetic permeability and especially suitable as susceptor material. The main component of ferrite is iron. Other metallic components, for example, zinc, nickel, manganese, or non-metallic components, for example silicon, may be present in varying amounts. Ferrite is a relatively inexpensive, commercially available material. Ferrite is available in particle form in the size ranges of the particles used in the particulate plant material forming the homogenised plant material according to the invention. Preferably, the particles are a fully sintered ferrite powder, such as for example FP160, FP215, FP350 by PPT, Indiana USA.

In certain embodiments of the invention, the aerosol-generating system comprises an aerosol-generating article comprising an aerosol-generating substrate as defined above, a source of aerosol former and a means to vaporise the aerosol former, preferably a heating element as described above. The source of aerosol former can be a reservoir, which can be refillable or replaceable, that resides on the aerosol generating device. While the reservoir is physically separate from the aerosol generating article, the vapour that is generated is directed through the aerosol-generating article. The vapour makes contact with the aerosol-generating substrate which releases volatile compounds, such as nicotine and flavourants in the particulate plant material, to form an aerosol. Optionally, to aid volatilization of compounds in the aerosol-generating substrate, the aerosol-generating system may further comprise a heating element to heat the aerosol-generating substrate, preferably in a co-ordinated manner with the aerosol former. However, in certain embodiments, the heating element used to heat the aerosol generating article is separate from the heater that heats the aerosol former.

As defined above, the present invention further provides an aerosol produced upon heating of an aerosol-generating substrate, wherein the aerosol comprises specific amounts and ratios of the characteristic compounds derived from rosemary particles as defined above.

Specific embodiments will be further described, by way of example only, with reference to the accompanying drawings in which.

Figure 4A:
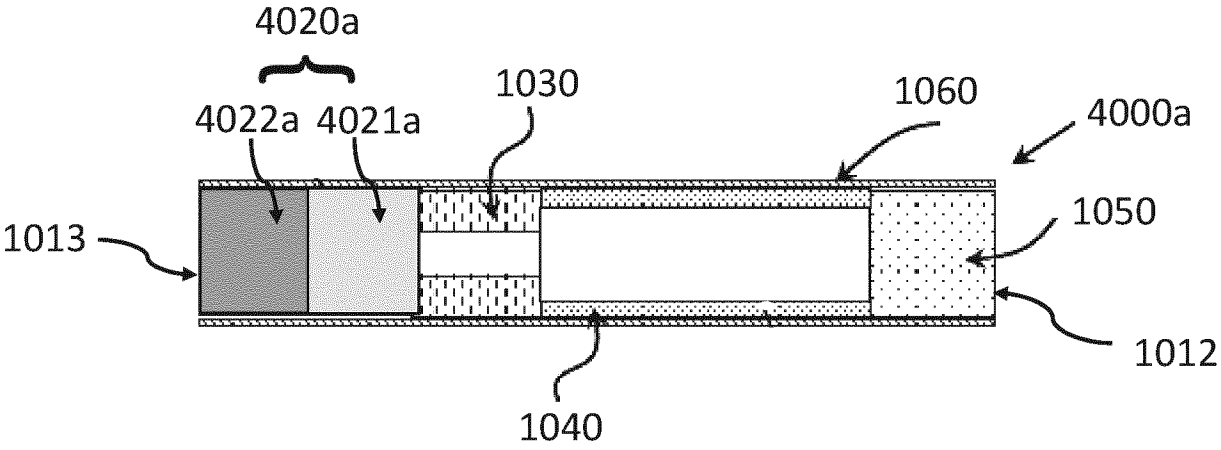
Figure 4B:
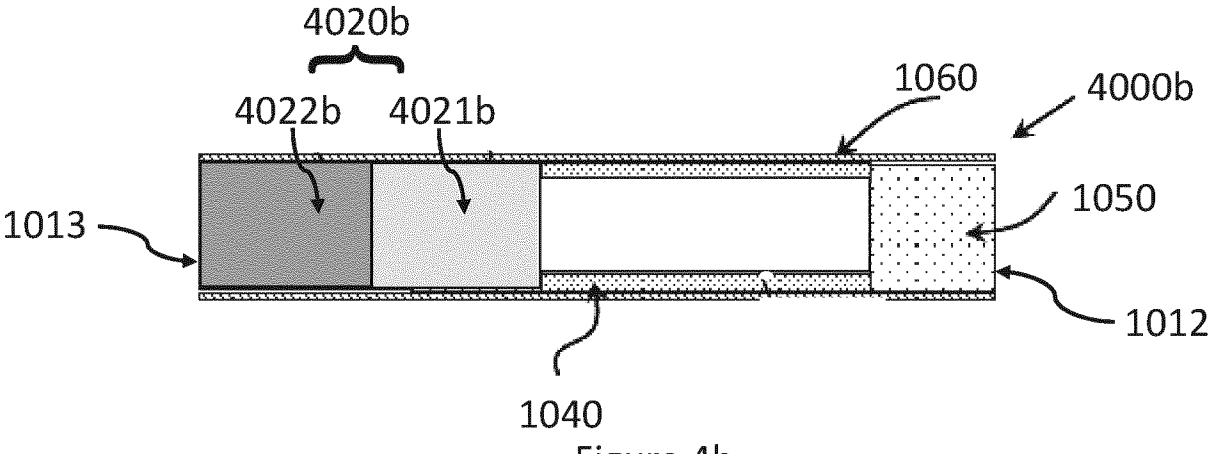
Figure 5:
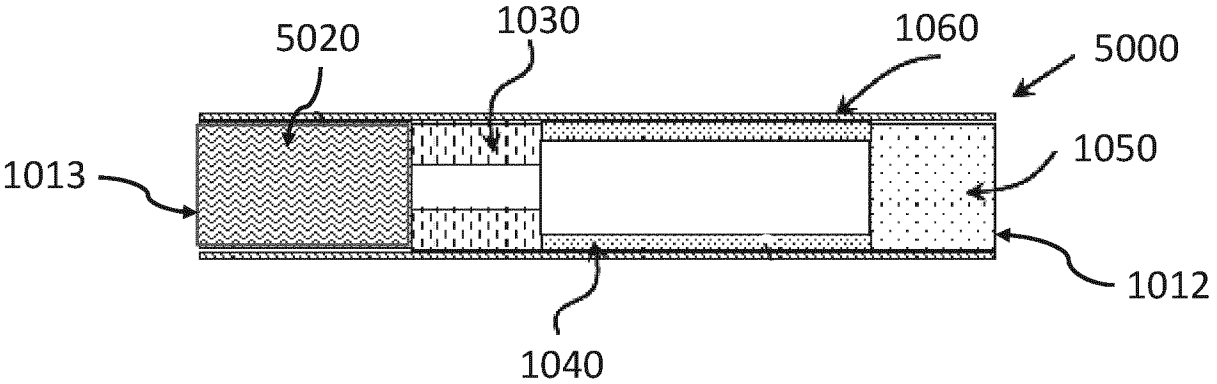
Figure 6B:
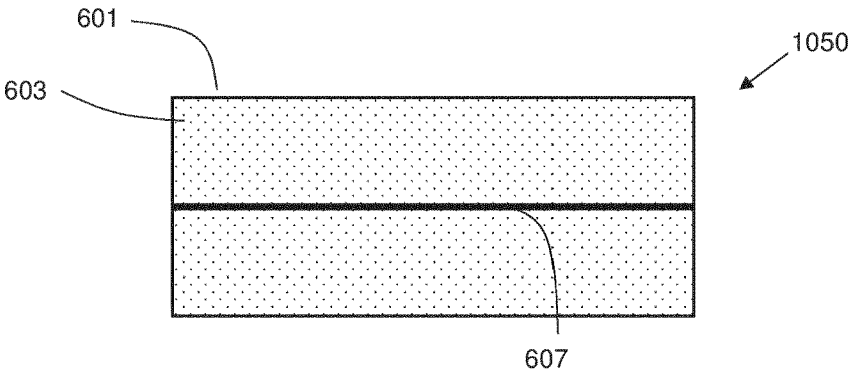
Figure 6A:
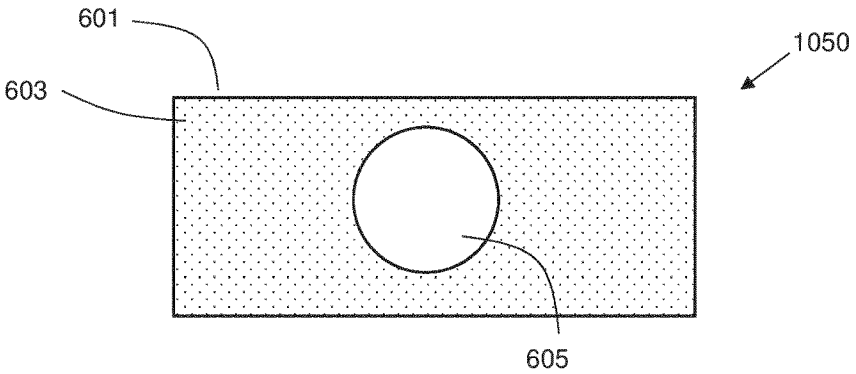

FIGS. 4*a* and 4*b* illustrate a second embodiment of a substrate of an aerosol-generating article as described herein;

FIG. 5 illustrates a third embodiment of a substrate of an aerosol-generating article as described herein;

FIG. 6 is a cross sectional view of filter 1050 further comprising an aerosol-modifying element, wherein FIG. 6*a* illustrates the aerosol-modifying element in the form of a spherical capsule or bead within a filter plug.

FIG. 6*b* illustrates the aerosol-modifying element in the form of a thread within a filter plug.

Figure 6C:
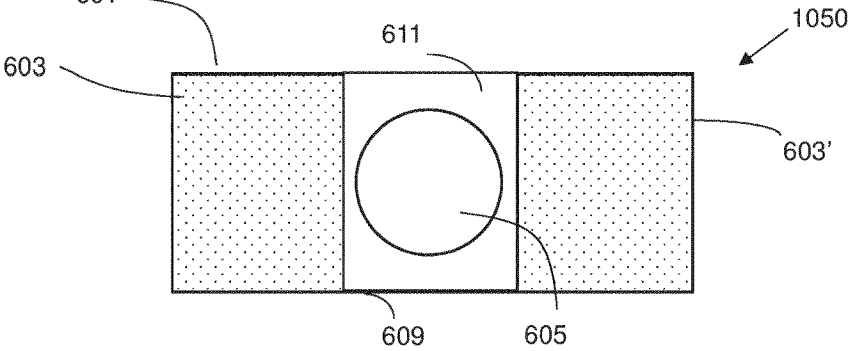
Figure 7:
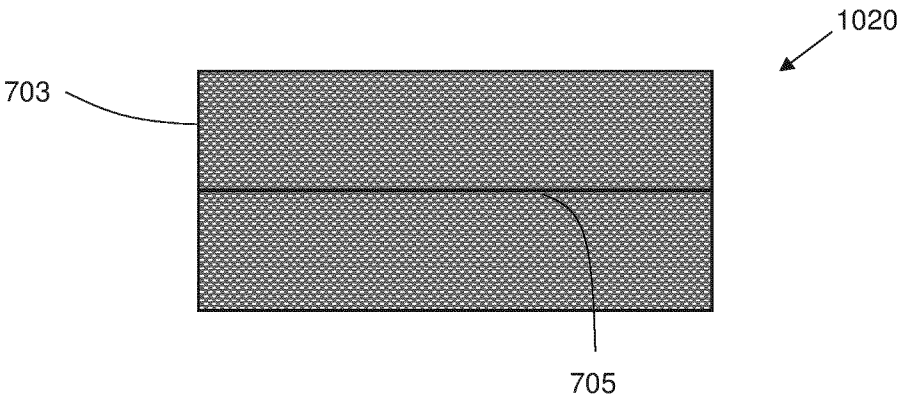
Figure 8:
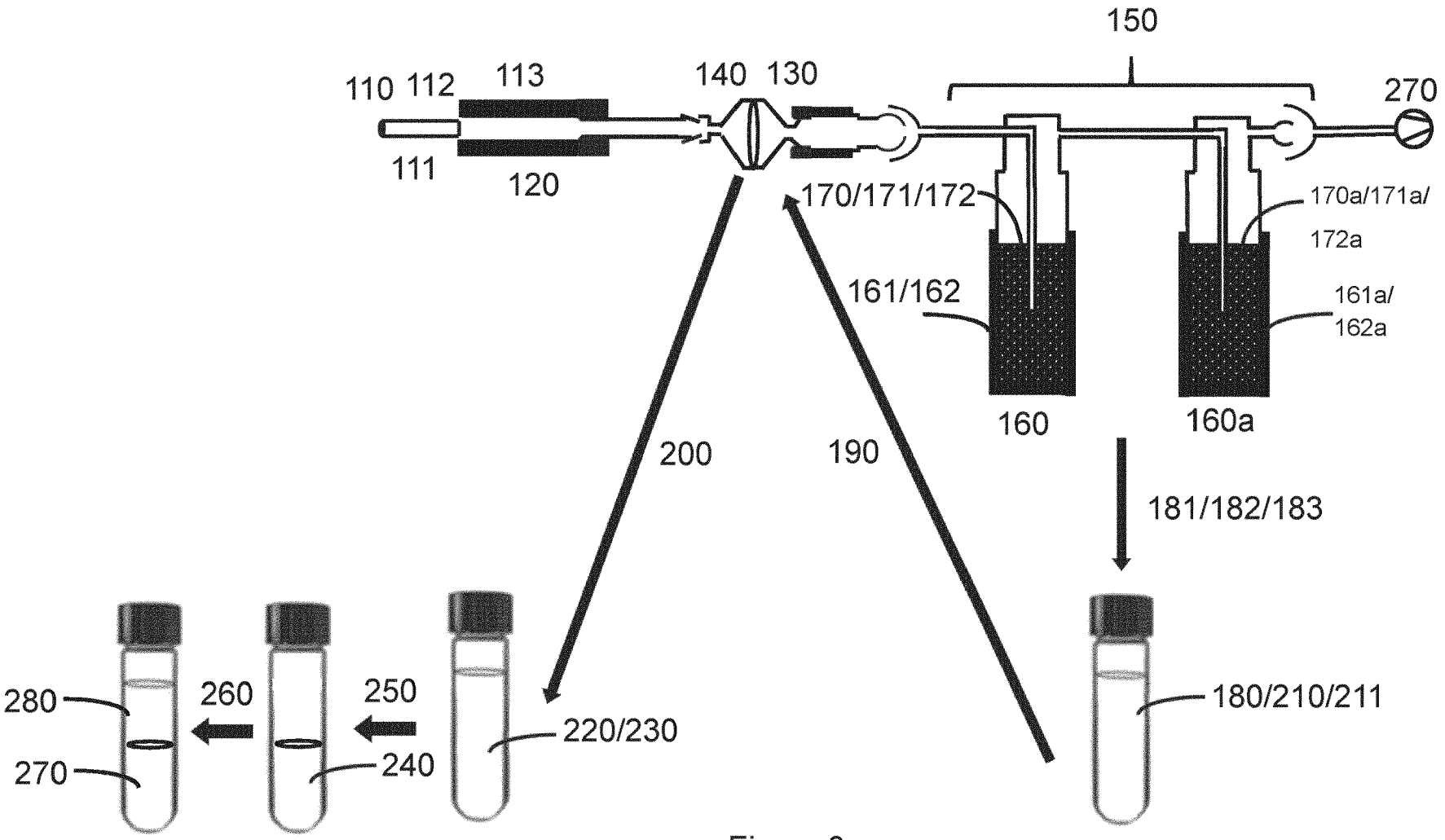

FIG. 6*c* illustrates the aerosol-modifying element in the form of a spherical capsule within a cavity within the filter;

FIG. 7 is a cross sectional view of a plug of aerosol-generating substrate 1020 further comprising an elongate susceptor element; and FIG. 8 illustrates an experimental set-up for collecting aerosol samples to be analysed in order to measure characteristic compounds.

Figure 1:
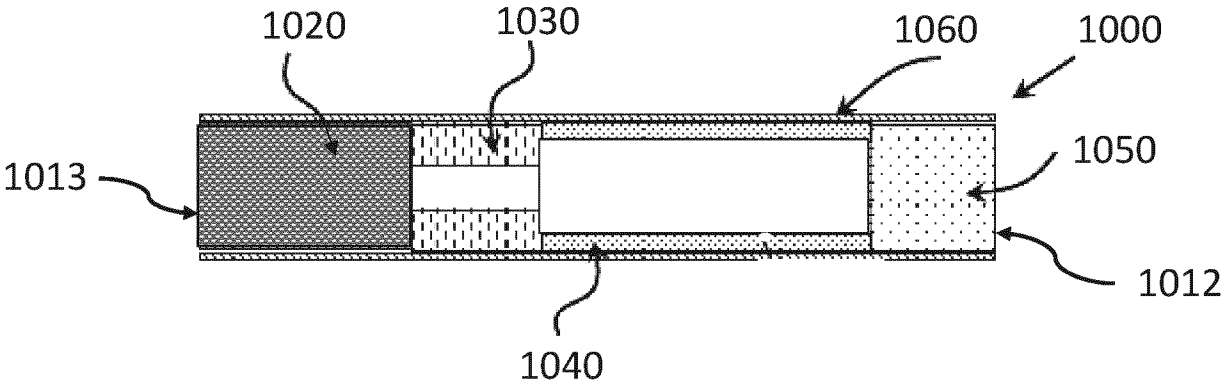
FIG. 1 illustrates a first embodiment of a substrate of an aerosol-generating article as described herein.

FIG. 1 illustrates a heated aerosol-generating article 1000 comprising a substrate as described herein. The article 1000 comprises four elements; the aerosol-generating substrate 1020, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 1 is particularly suitable for use with an electrically-operated aerosol-generating device comprising a heater for heating the aerosol-generating substrate.

When assembled, the article 1000 is about 45 millimetres in length and has an outer diameter of about 7.2 millimetres and an inner diameter of about 6.9 millimetres.

The aerosol-generating substrate 1020 comprises a plug formed from a sheet of homogenised plant material comprising rosemary particles, either alone or in combination with tobacco particles.

A number of examples of a suitable homogenised plant material for forming the aerosol-generating substrate 1020 are shown in Table 1 below (see Samples B to D). The sheet is gathered, crimped and wrapped in a filter paper (not shown) to form the plug. The sheet includes additives, including glycerol as an aerosol former.

An aerosol-generating article 1000 as illustrated in FIG. 1 is designed to engage with an aerosol-generating device in order to be consumed. Such an aerosol-generating device includes means for heating the aerosol-generating substrate 1020 to a sufficient temperature to form an aerosol. Typically, the aerosol-generating device may comprise a heating element that surrounds the aerosol-generating article 1000 adjacent to the aerosol-generating substrate 1020, or a heating element that is inserted into the aerosol-generating substrate 1020.

Once engaged with an aerosol-generating device, a user draws on the mouth-end 1012 of the smoking article 1000 and the aerosol-generating substrate 1020 is heated to a temperature of about 375 degrees Celsius. At this temperature, volatile compounds are evolved from the aerosol-generating substrate 1020. These compounds condense to form an aerosol. The aerosol is drawn through the filter 1050 and into the user's mouth.

Figure 2:
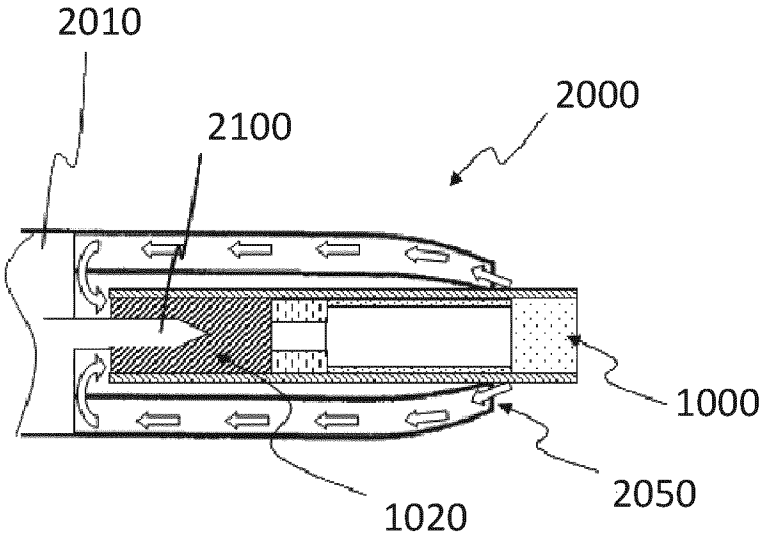
FIG. 2 illustrates an aerosol-generating system comprising an aerosol-generating article and an aerosol-generating device comprising an electric heating element.

FIG. 2 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. Air flow is indicated by arrows on FIG. 2. The aerosol-generating device comprises a power supply and electronics, which are not illustrated in FIG. 2. The aerosol-generating article 1000 of FIG. 2 is as described in relation to FIG. 1.

Figure 3:
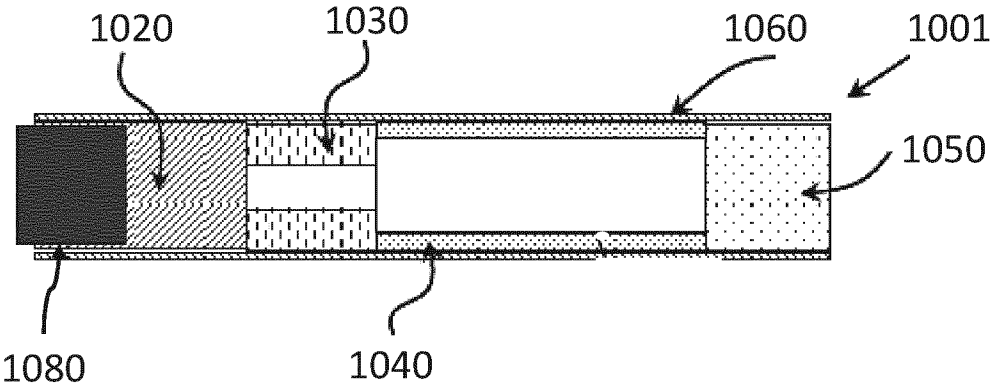
FIG. 3 illustrates an aerosol-generating system comprising an aerosol-generating article and an aerosol-generating device comprising a combustible heating element.

In an alternative configuration shown in FIG. 3, the aerosol-generating system is shown with a combustible heating element. While the article 1000 of FIG. 1 is intended to be consumed in conjunction with an aerosol-generating device, the article 1001 of FIG. 3 comprises a combustible heat source 1080 that may be ignited and transfer heat to the aerosol-generating substrate 1020 to form an inhalable aerosol. The combustible heat source 80 is a charcoal element that is assembled in proximity to the aerosol-generating substrate at a distal end 13 of the rod 11. Elements that are essentially the same as elements in FIG. 1 have been given the same numbering.

FIGS. 4*a* and 4*b* illustrate a second embodiment of a heated aerosol-generating article 4000*a*, 4000*b*. The aerosol-generating substrate 4020*a*, 4020*b* comprises a first downstream plug 4021 formed from of particulate plant material comprising rosemary particles, and a second upstream plug 4022 formed from particulate plant material comprising primarily tobacco particles. A suitable homogenised plant material for use in the first downstream plug is shown in Table 1 below as one of Samples B to D. A suitable homogenised plant material for use in the second upstream plug is shown in Table 1 below as Sample A. Sample A comprises only tobacco particles and is included for the purposes of comparison only.

In each of the plugs, the homogenised plant material is in the form of sheets, which are crimped and wrapped in a filter paper (not shown). The sheets both include additives, including glycerol as an aerosol former. In the embodiment shown in FIG. 4*a*, the plugs are combined in an abutting end to end relationship to form the rod and are of equal length of about 6 mm each. In a more preferred embodiment (not shown), the second plug is preferably longer than the first plug, for example, preferably 2 mm longer, more preferably 3 mm longer, such that the second plug is 7 or 7.5 mm in length while the first plug is 5 or 4.5 mm in length, to provide a desired ratio of tobacco to rosemary particles in the substrate. In FIG. 4*b*, the cellulose acetate tube support element 1030 has been omitted.

The article 4000*a*, 4000*b*, analogously to the article 1000 in FIG. 1, is particularly suitable for use with the electrically-operated aerosol-generating system 2000 comprising a heater shown in FIG. 2. Elements that are essentially the same elements in FIG. 1 have been given the same numbering. It may be envisaged by the skilled person that a combustible heat source (not shown) may be instead be used with the second embodiment in lieu of the electrical heating element, in a configuration similar to the configuration containing combustible heat source 1080 in article 1001 of FIG. 3.

FIG. 5 illustrates a third embodiment of a heated aerosol-generating article 5000. The aerosol-generating substrate 5020 comprises a rod formed from a first sheet of homogenised plant material formed of particulate plant material comprising a proportion of rosemary particles, and a second sheet of homogenised plant material comprising primarily cast-leaf tobacco.

A suitable homogenised plant material for use as the first sheet is shown in Table 1 below as one of Samples B to E. A suitable homogenised plant material for use as the second sheet is shown in Table 1 below as Sample A. Sample A comprises only tobacco particles and is included for the purposes of comparison only.

The second sheet overlies the first sheet, and the combined sheets have been crimped, gathered and at least partially wrapped in a filter paper (not shown) to form a plug that is part of the rod. Both sheets include additives, including glycerol as an aerosol former. The article 5000, analogously to the article 1000 in FIG. 1, is particularly suitable for use with the electrically-operated aerosol-generating system 2000 comprising a heater shown in FIG. 2. Elements that are essentially the same elements in FIG. 1 have been given the same numbering. It may be envisaged by the skilled person that a combustible heat source (not shown) may be instead be used with the third embodiment in lieu of the electrical heating element, in a configuration similar to the configuration containing combustible heat source 1080 in article 1001 of FIG. 3.

FIG. 6 is a cross sectional view of filter 1050 further comprising an aerosol-modifying element. In FIG. 6*a*, the filter 1050 further comprises an aerosol-modifying element in the form of a spherical capsule or bead 605.

In the embodiment of FIG. 6*a*, the capsule or bead 605 is embedded in the filter segment 601 and is surrounded on all sides by the filter material 603. In this embodiment, the capsule comprises an outer shell and an inner core, and the inner core contains a liquid flavourant. The liquid flavourant is for flavouring aerosol during use of the aerosol-generating article provided with the filter. The capsule 605 releases at least a portion of the liquid flavourant when the filter is subjected to external force, for example by squeezing by a consumer. In the embodiment shown, the capsule is generally spherical, with a substantially continuous outer shell containing the liquid flavourant.

In the embodiment of FIG. 6*b*, the filter segment 601 comprises a plug of filter material 603 and a central flavour-bearing thread 607 that extends axially through the plug of filter material 603 parallel to the longitudinal axis of the filter 1050. The central flavour-bearing thread 607 is of substantially the same length as the plug of filter material 603, so that the ends of the central flavour-bearing thread 607 are visible at the ends of the filter segment 601. In FIG. 6*b*, filter material 603 is cellulose acetate tow. The central flavour-bearing thread 607 is formed from twisted filter plug wrap and loaded with an aerosol-modifying agent.

In the embodiment of FIG. 6*c*, the filter segment 601 comprises more than one plug of filter material 603, 603'. Preferably, the plugs of filter material 603, 603' are formed from cellulose acetate, such that they are able to filter the aerosol provided by the aerosol generating article. A wrapper 609 is wrapped around and connects filter plugs 603, 603'. Inside a cavity 611 is a capsule 605 comprising an outer shell and an inner core, and the inner core contains a liquid flavourant. The capsule is otherwise similar to the embodiment of FIG. 6*a*.

FIG. 7 is a cross sectional view of aerosol-generating substrate 1020 further comprising an elongate susceptor strip 705. The aerosol-generating substrate 1020 comprises a plug 703 formed from a sheet of homogenised plant material comprising tobacco particles and rosemary particles. The elongate susceptor strip 705 is embedded within the plug 703 and extends in a longitudinal direction between the upstream and downstream ends of the plug 703. During use, the elongate susceptor strip 705 heats the homogenised plant material by means of induction heating, as described above.

EXAMPLE 1

Different samples of homogenised plant material for use in an aerosol-generating substrate according to the invention, as described above with reference to the figures, were prepared from aqueous slurries having compositions shown Table 1. Samples B to E comprise rosemary particles, in accordance with a preferred embodiment of the invention. In Samples B to D, the rosemary particles are combined with tobacco particles. Sample A comprises tobacco particles only. Sample E comprises rosemary particles only.

The particulate plant material in all samples A to E accounted for 65 percent of the dry weight of the homogenised plant material, with glycerol, CMC, cellulose powder and cellulose reinforcement fibers accounting for the remaining 35 percent of the dry weight of homogenised plant material.

In the table below, % DWB refers to the "dry weight base," in this case, the percent by weight calculated relative to the dry weight of the homogenised plant material. The rosemary powder was formed from *Rosmarinus Officinalis* leaves from Spain, which was ground to a final D95=133 microns by triple impact milling. The rosemary powder was sieved to remove particles above 200 microns. In more detail, Sample E was prepared from an aqueous slurry containing:

Rosemary: 17.78 kg/100 kg of slurry
Glycerol: 4.50 kg/100 kg of slurry
CMC: 1.25 kg/100 kg of slurry
Cellulose powder: 2.50 kg/100 kg of slurry
Cellulose fibres: 1.00 kg/100 kg of slurry
Water: 72.97 kg/100 kg of slurry.

TABLE 1

Dry content of slurries

| Sample | Rosemary (% DWB) | Tobacco (% DWB) | Glycerol (% DWB) | CMC (% DWB) | Cellulose powder (% DWB) | Cellulose fibers (% DWB) |
|---|---|---|---|---|---|---|
| A | 0 | 65 | 17 | 5 | 9 | 4 |
| B | 1 | 64 | 17 | 5 | 9 | 4 |
| C | 6.5 | 58.5 | 17 | 5 | 9 | 4 |
| D | 13 | 52 | 17 | 5 | 9 | 4 |
| E | 65 | 0 | 17 | 5 | 9 | 4 |

The slurries were cast using a casting bar (0.6 mm) on a glass plate, dried in an oven at 140 degrees Celsius and then dried in a second oven at 135 degrees Celsius.

For each of the samples A to E of homogenised plant material, a plug was produced from a single continuous sheet of the homogenised plant material, the sheets each having widths of between 100 mm to 125 mm. The individual sheets had a thickness of about 220 microns and a grammage of about 135 g/m$^2$. The cut width of each sheet was adapted based on the thickness of each sheet to produce rods of comparable volume. The sheets were crimped to a height of 165 microns to 170 microns, and rolled into plugs having a length of about 12 mm and diameters of about 7 mm, circumscribed by a paper wrapper.

For each of the plugs, an aerosol-generating article having an overall length of about 45 mm was formed having a structure as shown in FIG. 3 comprising, from the downstream end: a mouth end cellulose acetate filter (about 7 mm long), an aerosol spacer comprising a crimped sheet of polylactic acid polymer (about 18 mm long), a hollow acetate tube (about 8 mm long) and the plug of aerosol-generating substrate.

For Sample E of homogenised plant material, for which rosemary particles make up 100 percent of the plant particles, the characteristic compounds of the rosemary were extracted from the plug of homogenised plant material using methanol as detailed above. The extract was analysed as described above to confirm the presence of the characteristic compounds and to measure the amounts of the characteristic compounds. The results of this analysis are shown below in Table 2, wherein the amounts indicated correspond to the amount per aerosol-generating article, wherein the aerosol-generating substrate of the aerosol-generating article contained 178 mg of the Sample E of homogenised plant material.

For the purposes of comparison, the amounts of the characteristic compounds present in the particulate plant material (rosemary particles) used to form Sample E are also shown. For the particulate material, the amounts indicated correspond to the amount of the characteristic compound in a sample of particulate plant material having a weight corresponding to the total weight of the particulate plant material in the aerosol-generating article containing 178 mg of Sample E.

TABLE 2

Amount of rosemary-specific compounds in the particulate plant material and in the aerosol-generating substrate

| Characteristic Compound | Amount in the particulate plant material (micrograms per article) | Amount in the aerosol-generating substrate (micrograms per article) |
|---|---|---|
| Betulinic acid | 717 | 608 |
| Rosmaridiphenol | 243 | 290 |
| 12-O-methylcarnosol | 5.6 | 3.9 |

For each of the samples B to D comprising a proportion of rosemary particles, the amount of the characteristic compounds can be estimated based on the values in Table 2 by assuming that the amount is present in proportion to the weight of the rosemary particles.

Mainstream aerosols of the aerosol-generating articles incorporating aerosol-generating substrates formed from Samples A to E of homogenised plant material were generated in accordance with Test Method A, as defined above. For each sample, the aerosol that was produced was trapped and analysed.

As described in detail above, according to Test Method A, the aerosol-generating articles were tested using the commercially available IQOS® heat-not-burn device tobacco heating system 2.2 holder (THS2.2 holder) from Philip Morris Products SA. The aerosol-generating articles were heated under a Health Canada machine-smoking regimen over 30 puffs with a puff volume of 55 ml, puff duration of 2 seconds and a puff interval of 30 seconds (as described in ISO/TR 19478-1:2014).

The aerosol generated during the smoking test was collected on a Cambridge filter pad and extracted with a liquid solvent. FIG. 10 shows suitable apparatus for generating and collecting the aerosol from the aerosol-generating articles.

Aerosol-generating device 111 shown in FIG. 10 is a commercially available tobacco heating device (IQOS). The contents of the mainstream aerosol generated during the Health Canada smoking test as detailed above were collected in aerosol collection chamber 113 on aerosol collection line 120. Glass fiber filter pad 140 is a 44 mm Cambridge glass fiber filter pad (CFP) in accordance with ISO 4387 and ISO 3308.

For LC-HRAM-MS Analysis:

Extraction solvent 170, 170*a*, which in this case is methanol and internal standard (ISTD) solution, is present at a volume of 10 mL in each micro-impinger 160, 160*a*. The cold baths 161, 161*a* each contain a dry ice-isopropyl ether to maintain the micro-impingers 160, 160*a* each at approximately −60° C. The gas-vapour phase is trapped in the extraction solvent 170, 170*a* as the aerosol bubbles through micro-impingers 160, 160*a*. The combined solutions from the two micro-impingers are isolated as impinger-trapped gas-vapor phase solution 180 in step 181.

The CFP and the impinger-trapped gas-vapor phase solution 180 are combined in a clean Pyrex® tube in step 190. In step 200, the total particulate matter is extracted from the CFP using the impinger-trapped gas-vapor phase solution 180 (which contains methanol as a solvent) by thoroughly shaking (disintegrating the CFP), vortexing for 5 min and finally centrifuging (4500 g, 5 min, 10° C.). Aliquots (300 μL) of the reconstituted whole aerosol extract 220 were transferred into a silanized chromatographic vial and diluted with methanol (700 μL), since the extraction solvent 170, 170*a* already comprised internal standard (ISTD) solution. The vials were closed and mixed for 5 minutes using an Eppendorf ThermoMixer (5° C.; 2000 rpm).

Aliquots (1.5 μL) of the diluted extracts were injected and analyzed by LC-HRAM-MS in both full scan mode and data-dependent fragmentation mode for compound identification.

For GC×GC-TOFMS Analysis:

As discussed above, when samples for GC×GC-TOFMS experiments are prepared, different solvents are suitable for extracting and analysing polar compounds, non-polar compounds and volatile compounds separated from whole aerosol. The experimental set-up is identical to that described with respect to sample collection for LC-HRAM-MS, with the exceptions indicated below.

Nonpolar & Polar

Extraction solvent 171,171*a*, is present at a volume of 10 mL and is an 80:20 v/v mixture of dichlormethane and methanol, also containing retention-index marker (RIM) compounds and stable isotopically labeled internal standards (ISTD). The cold baths 162, 162*a* each contain a dry ice-isopropanol mixture to maintain the micro-impingers 160, 160*a* each at approximately −78° C. The gas-vapor phase is trapped in the extraction solvent 171, 171*a* as the aerosol bubbles through micro-impingers 160, 160*a*. The combined solutions from the two micro-impingers are isolated as impinger-trapped gas-vapor phase solution 210 in step 182.

Nonpolar

The CFP and the impinger-trapped gas-vapor phase solution 210 are combined in a clean Pyrex® tube in step 190. In step 200, the total particulate matter is extracted from the CFP using the impinger-trapped gas-vapor phase solution 210 (which contains dichloromethane and methanol as a solvent) by thoroughly shaking (disintegrating the CFP), vortexing for 5 min and finally centrifuging (4500 g, 5 min, 10° C.) to isolate the polar and non-polar components of the whole aerosol extract 230.

In step 250, an 10 mL aliquot 240 of the whole aerosol extract 230 was taken. In step 260, a 10 mL aliquot of water is added, and the entire sample is shaken and centrifuged. The non-polar fraction 270 was separated, dried with sodium sulfate and analysed by GC×GC-TOFMS in full scan mode.

Polar

ISTD and RIM compounds were added to polar fraction 280, which was then directly analysed by GC×GC-TOFMS in full scan mode.

Each smoking replicate (n=3) comprises the accumulated trapped and reconstituted non-polar fraction 270 and polar fraction 280 for each sample Volatile Components Whole aerosol was trapped using two micro-impingers 160, 160*a* in series. Extraction solvent 172, 172*a*, which in this case is N,N-dimethylformamide (DMF) containing retention-index marker (RIM) compounds and stable isotopically labeled internal standards (ISTD), is present at a volume of 10 mL in each micro-impinger 160, 160*a*. The cold baths 161, 161*a* each contain a dry ice-isopropyl ether to maintain the micro-impingers 160, 160*a* each at approximately −60° C. The gas-vapor phase is trapped in the extraction solvent 170, 170*a* as the aerosol bubbles through micro-impingers 160, 160*a*. The combined solutions from the two micro-impingers are isolated as a volatile-containing phase 211 in step 183. The volatile-containing phase 211 is analysed separately from the other phases and injected directly into the GC×GC-TOFMS using cool-on-column injection without further preparation.

Table 3 below shows the levels of the characteristic compounds from the rosemary particles in the aerosol generated from an aerosol-generating article incorporating Sample E of homogenised plant material, including rosemary particles only. For the purposes of comparison, Table 3 also shows the levels of the characteristic compounds in the aerosol generated from an aerosol-generating article incorporating Sample A of homogenised plant material, including tobacco particles only (and therefore not in accordance with the invention).

TABLE 3

| Content of characteristic compounds in aerosol | | | | |
|---|---|---|---|---|
| Compound | Sample A (micrograms per article) | Sample E (micrograms per gram) | Sample E (micrograms per 55 ml puff) | Sample E (micrograms per article) |
| Betulinic acid | 0 | 2275 | 33.75 | 405 |
| Rosmaridiphenol | 0 | 109 | 1.62 | 19.4 |
| 12-O-methylcarnosol | 0 | 118.5 | 0.68 | 21.1 |

For example, in an aerosol generated from Sample E, relatively high levels of the characteristic compounds would be measured. The ratio of betulinic acid to rosmaridiphenol would typically be greater than 20:1. Measured levels of the characteristic compounds within the ranges above would be indicative of the presence of rosemary particles in the sample and a composition of the homogenised sheet as defined above. In contrast, for the tobacco only Sample A, which contained substantially no rosemary particles, the levels of the characteristic compounds would be found to be at or close to zero.

For each of the samples B to D comprising a proportion of rosemary particles, the amount of the characteristic compounds in the aerosol can be estimated based on the values in Table 3 by assuming that the amount is present in proportion to the weight of the rosemary particles in the aerosol-generating substrate from which the aerosol is generated.

The aerosol produced by Sample E containing 65 percent by weight rosemary powder was also found to result in reduced levels of several undesired aerosol constituents when compared to the level of the aerosol in Sample A produced using 100 percent by weight tobacco based on the dry weight of the particulate plant material.

EXAMPLE 2

Sheets of homogenised plant material according to the invention were formed using the compositions shown as Recipe 1 and Recipe 2 below in Table 4. For the purposes of comparison, a third sheet of homogenised plant material using an alternative binder (and therefore not according to the invention) was formed using the composition shown as Recipe 3 below in Table 4. All of the sheets incorporated a relatively high level of rosemary particles and were formed using a cast leaf method as set out above in Example 1.

TABLE 4

| Dry content of slurries | | | | | | |
|---|---|---|---|---|---|---|
| Sample | Rosemary powder (% DWB) | Glycerol (% DWB) | Guar (% DWB) | CMC (% DWB) | Cellulose powder (% DWB) | Cellulose fibers (% DWB) |
| 1 | 57 | 25 | 0 | 5 | 10 | 3 |
| 2 | 54 | 35 | 0 | 5 | 0 | 6 |
| 3 | 75 | 18 | 3 | 0 | 0 | 4 |

The cast leaf formed from Samples 1 and 2 in accordance with the invention were both found to be homogenous in texture with a relatively uniform thickness and high tensile strength. The cast leaf could be readily removed from the casting plate and formed into a rod of aerosol-generating substrate. In contrast, the cast leaf formed from Sample 3, using a known binder instead of the combination of CMC and cellulose, was found to be porous and fragile with virtually no tensile strength. The cast leaf could not be readily detached from the casting plate and was found to fragment such that it could not be formed into a rod of aerosol-generating substrate. This example demonstrates that the use of the combination of CMC and additional cellulose in place of the guar gum binder provides a significantly improved sheet of homogenised plant material, with a greatly improved tensile strength and homogeneity.

The cast leaf formed from Sample 2 has a relatively high level of aerosol former (35 percent by weight) and is particularly suitable for use in forming the aerosol-generating substrate of an aerosol-generating article which is intended to be heated to a temperature of below 275 degrees Celsius.

When heated to a temperature of around 265 degrees Celsius, an aerosol-generating substrate produced from the cast leaf formed from Sample 2 was found to provide a significantly improved aerosol delivery compared to the cast leaf from Sample 3. In particular, the aerosol delivery was improved to a greater extent than would be expected based on the level of aerosol former alone. This demonstrates the improvement in aerosol delivery provided by incorporating the CMC binder in place of the guar gum.

EXAMPLE 3

The following homogenised plant materials according to the invention were produced using a casting leaf method as described above for Example 1, each with a different type of non-tobacco plant material. For each plant material, the composition shown below in Table 5 was used:

TABLE 5

| Composition of homogenised plant materials | |
|---|---|
| Component | Amount (% DWB) |
| Plant powder | 54 |
| CMC | 5 |
| Cellulose fibers | 6 |
| Glycerol | 35 |

The properties of the resultant homogenised plant materials are shown in Table 6 below.

TABLE 6

| Properties of homogenised plant materials | | | |
|---|---|---|---|
| Plant powder | Grammage (g/m2) | Thickness (microns) | Manufacturing observations |
| Star anise | 209 | 409 | Good sheet quality. High thickness |
| Ginger | 207 | 221 | Good sheet quality |
| Clove | 209 | 215 | Good sheet quality |
| Eucalyptus | 197 | 218 | Good sheet quality |
| Rosemary | 135 | 223 | Good sheet quality |

In each case, the resultant homogenised plant material was found to have an acceptable thickness and tensile strength to enable it to be incorporated into an aerosol-generating article.

The invention claimed is:

1. An aerosol-generating article comprising an aerosol-generating substrate, the aerosol-generating substrate formed of a homogenised plant material, comprising:
- between 1 percent by weight and 65 percent by weight of non-tobacco plant particles, on a dry weight basis;
- between 15 percent by weight and 55 percent by weight of aerosol former, on a dry weight basis;
- between 5 percent by weight and 10 percent by weight of cellulose ether, on a dry weight basis; and
- between 5 percent by weight and 50 percent by weight of additional cellulose, on a dry weight basis, wherein
- the non-tobacco particles comprise star anise particles,
- the non-tobacco plant particles have a D95 value of between 200 microns and 300 microns,
- the additional cellulose is in a form of isolated cellulose and is not derived from the non-tobacco plant particles, and
- a ratio of additional cellulose to cellulose ether on a weight basis in the homogenised plant material is at least 2.

2. The aerosol-generating substrate according to claim 1, wherein the homogenised plant material further comprises at least 1 percent by weight of tobacco particles.

3. The aerosol-generating article according to claim 2, wherein the homogenised plant material comprises:
- between 50 percent by weight and 65 percent by weight of tobacco particles on a dry weight basis, and
- between 15 percent by weight and 25 percent by weight of aerosol former on a dry weight basis.

4. The aerosol-generating article according to claim 2, wherein the homogenised plant material comprises:
- between 10 percent by weight and 55 percent by weight of tobacco particles on a dry weight basis, and
- between 30 percent by weight and 45 percent by weight of aerosol former on a dry weight basis.

5. The aerosol-generating article according to claim 1, wherein the additional cellulose comprises cellulose powder and wherein the amount of cellulose powder corresponds to at least 5 percent by weight of the homogenised plant material, on a dry weight basis.

6. The aerosol-generating article according to claim 5, wherein a ratio of cellulose powder to cellulose ether in the homogenised plant material is at least 1.5.

7. The aerosol-generating article according to claim 5, wherein the cellulose powder has at least 95 percent by weight of cellulose.

8. The aerosol-generating article according to claim 5, wherein the cellulose powder has at least 97 percent by weight of cellulose.

9. The aerosol-generating article according to claim 1,
- wherein the additional cellulose comprises cellulose reinforcement fibers, and
- wherein an amount of cellulose reinforcement fibers corresponds to at least 3 percent by weight of the homogenised plant material, on a dry weight basis.

10. The aerosol-generating article according to claim 9, wherein a ratio of cellulose reinforcement fibers to cellulose ether in the homogenised plant material is at least 1.

11. The aerosol-generating article according to claim 1,
- wherein the additional cellulose comprises cellulose powder and cellulose reinforcement fibers, and
- wherein a ratio of cellulose powder to cellulose reinforcement fibers is at least 1.5.

12. The aerosol-generating article according to claim 1, wherein the cellulose ether comprises carboxymethyl cellulose (CMC).

13. The aerosol-generating article according to claim 1, wherein a total amount of the non-tobacco plant particles and the additional cellulose is no more than 75 percent by weight of the homogenised plant material, on a dry weight basis.

14. The aerosol-generating article according to claim 1, wherein the homogenised plant material comprises:
- between 50 percent by weight and 65 percent by weight of non-tobacco particles on a dry weight basis, and
- between 15 percent by weight and 25 percent by weight of aerosol former on a dry weight basis.

15. The aerosol-generating article according to claim 1, wherein the homogenised plant material comprises:
- between 10 percent by weight and 55 percent by weight of non-tobacco particles on a dry weight basis, and
- between 30 percent by weight and 45 percent by weight of aerosol former on a dry weight basis.

16. An aerosol-generating article comprising an aerosol-generating substrate, the aerosol-generating substrate formed of a homogenised plant material, comprising:
- between 1 percent by weight and 65 percent by weight of tobacco particles, on a dry weight basis;
- between 15 percent by weight and 55 percent by weight of aerosol former, on a dry weight basis;
- between 5 percent by weight and 10 percent by weight of cellulose ether, on a dry weight basis; and
- between 5 percent by weight and 50 percent by weight of additional cellulose, on a dry weight basis, wherein
- the tobacco particles have a D95 value of between 200 microns and 300 microns,
- the additional cellulose is in a form of isolated cellulose and is not derived from the tobacco particles, and a ratio of additional cellulose to cellulose ether on a weight basis in the homogenised plant material is at least 2.

* * * * *